US009744783B2

(12) United States Patent
Hosokawa

(10) Patent No.: US 9,744,783 B2
(45) Date of Patent: Aug. 29, 2017

(54) LIQUID EJECTING APPARATUS, LIQUID EJECTING METHOD, AND NON-TRANSITORY RECORDING MEDIUM

(71) Applicant: Toshiaki Hosokawa, Kanagawa (JP)

(72) Inventor: Toshiaki Hosokawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/391,098

(22) Filed: Dec. 27, 2016

(65) Prior Publication Data

US 2017/0197444 A1 Jul. 13, 2017

(30) Foreign Application Priority Data

Jan. 8, 2016 (JP) ..... 2016-002381

(51) Int. Cl.

| | |
|---|---|
| ***B41J 23/00*** | (2006.01) |
| ***B41J 25/00*** | (2006.01) |
| *B41J 3/36* | (2006.01) |
| *B41J 2/125* | (2006.01) |

(52) U.S. Cl.

CPC ..... *B41J 25/001* (2013.01); *B41J 23/00* (2013.01); *B41J 2/125* (2013.01); *B41J 3/36* (2013.01)

(58) Field of Classification Search

CPC ..... B41J 23/00; B41J 23/025; B41J 25/001; B41J 3/36; B41J 3/39; B41J 11/008; B41J 2/125; B41J 3/4073

See application file for complete search history.

(56) References Cited

U.S. PATENT DOCUMENTS

| | | | | |
|---|---|---|---|---|
| 7,748,839 | B2 * | 7/2010 | Noe | B41J 3/36 347/109 |
| 9,205,671 | B1 * | 12/2015 | Simmons | G06F 3/1292 |
| 9,352,598 | B2 | 5/2016 | Nakata et al. | |
| 9,440,452 | B2 | 9/2016 | Harada et al. | |

FOREIGN PATENT DOCUMENTS

| | | |
|---|---|---|
| JP | H11-202690 | 7/1999 |

* cited by examiner

*Primary Examiner* — Thinh H Nguyen
(74) *Attorney, Agent, or Firm* — IPUSA, PLLC

(57) ABSTRACT

A liquid ejecting apparatus for ejecting materials on a recording medium in accordance with a position of the apparatus and an image to be formed. The apparatus, movable on the recording medium by an external force, includes a position calculating unit configured to calculate the position; an electric power supplying unit configured to supply electric power to a part that the position calculating unit uses to calculate the position when a state of the apparatus changes to a second operating mode whose electric power consumption is less than that of a first operating mode of ejecting the materials; and a return factor detecting unit configured to detect a return factor for returning to the first operating mode from the second operating mode. When returning to the first operating mode, the apparatus restarts to eject the materials from the position that has been calculated in the second operating mode.

18 Claims, 19 Drawing Sheets

LIQUID EJECTING APPARATUS, LIQUID EJECTING METHOD, AND NON-TRANSITORY RECORDING MEDIUM

CROSS-REFERENCE TO RELATED APPLICATIONS

The present application claims the benefit of priority under 35 U.S.C. §119 of Japanese Patent Application No. 2016-002381 filed on Jan. 8, 2016, the contents of which are incorporated herein by reference in their entirety.

BACKGROUND OF THE INVENTION

1. Field of the Invention

The disclosures herein generally relate to a liquid ejecting apparatus, a liquid ejecting method, and a non-transitory recording medium.

2. Description of the Related Art

A printer, which ejects ink or the like to form an image, is known in the related art. The printer conveys a sheet and ejects ink at timing at which the sheet reaches a position where the image is formed. In accordance with downsizing of note PCs and the spread of smart devices, there is a great demand for portable compact printer apparatuses. To respond to this demand, a printer (referred to as HMP: handy mobile printer, hereinafter) downsized by omitting a sheet conveyance system from a printer apparatus is developed toward practical use. Because the sheet conveying system is not mounted on the HMP, the HMP is moved by a human hand on a plane of the sheet. Thereby, the HMP ejects ink while scanning on the plane of the sheet.

In many cases, a printer in the related art has a function for changing to be in an energy-saving mode in a state where a user does not use the printer (for example, see Japanese Unexamined Patent Application Publication No. H11-202690). Japanese Unexamined Patent Application Publication No. 11-202690 discloses an image forming apparatus that changes to be in the energy-saving mode in a case where a person does not use the image forming apparatus. When detecting that the person approaches the image forming apparatus, the image forming apparatus returns to be in a normal mode.

SUMMARY OF THE INVENTION

It is a general object of at least one embodiment of the present disclosure to provide a liquid ejecting apparatus, a liquid ejecting method, and a non-transitory recording medium that substantially obviate one or more problems caused by the limitations and disadvantages of the related art.

According to one aspect of the present disclosure, there is provided a liquid ejecting apparatus for ejecting materials on a recording medium in accordance with a position of the liquid ejecting apparatus on the recording medium and an image that is to be formed on the recording medium. The liquid ejecting apparatus is movable on the recording medium by an external force. The liquid ejecting apparatus includes a position calculating unit configured to calculate the position of the liquid ejecting apparatus on the recording medium; an electric power supplying unit configured to supply electric power to a part that the position calculating unit uses to calculate the position when a state of the liquid ejecting apparatus changes to a second operating mode whose electric power consumption is less than an electric power consumption of a first operating mode of ejecting the materials on the recording medium; and a return factor detecting unit configured to detect a return factor for returning the state of the liquid ejecting apparatus to the first operating mode from the second operating mode. When the state of the liquid ejecting apparatus returns to the first operating mode from the second operating mode, the liquid ejecting apparatus restarts to eject the materials from the position that has been calculated by the position calculating unit in the second operating mode.

DESCRIPTION OF THE PREFERRED EMBODIMENTS

Figure 1:
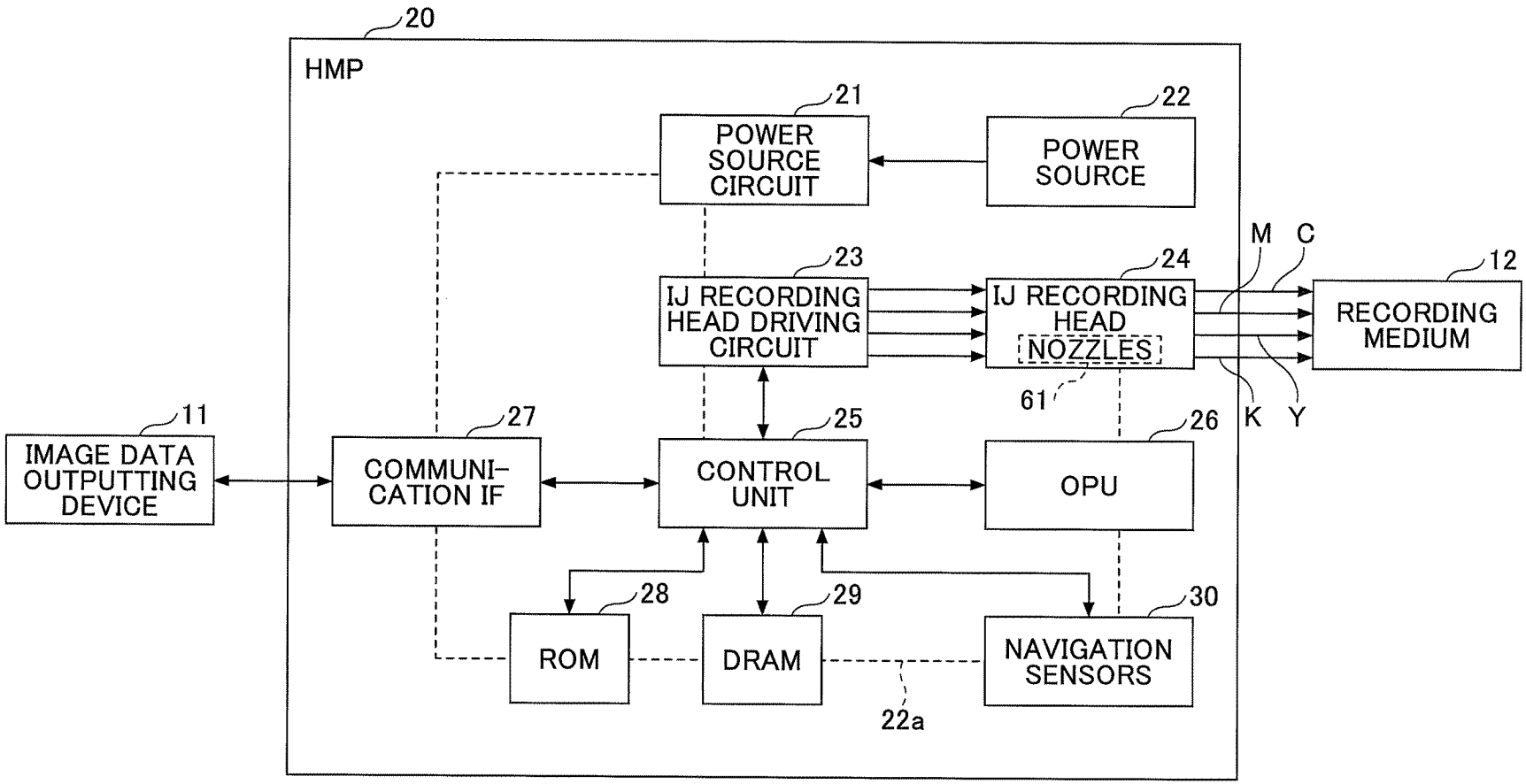
FIG. 1 is a block diagram illustrating an example of a hardware configuration of a HMP according to a first embodiment.

In the following, embodiments of the present disclosure will be described with reference to the accompanying drawings. The present disclosure has an object to provide a liquid ejecting apparatus that can suppress wasteful electric power consumption.

First Embodiment

<Outline of a Handy Mobile Printer According to a First Embodiment>

A handy mobile printer according to a first embodiment operates as follows so as to suppress wasteful electric power consumption. In the following, the handy mobile printer is referred to as the HMP. A user applies an external force to the HMP to move the HMP 20 on (or over) a recording medium. For example, the user may hold the HMP 20 to move the HMP 20 relative to the recording medium. The HMP 20 ejects ink when a detected position becomes a target ejection position. In other words, the HMP 20, which is an example of an ejecting apparatus, can eject materials on the recording medium in accordance with a position of the HMP 20 on the recording medium and an image that is to be formed on the recording medium.

(1) In a case where the position of the HMP 20 does not change, the HMP 20 changes to be in a power-saving mode. In this way, it is possible to suppress the wasteful electric power consumption in a state in which the user does not use the HMP 20.

(2) The HMP 20 continuously calculates the position of the HMP 20 even after the HMP changes to be in the energy-saving mode.

(3) When detecting a return factor for returning from the energy-saving mode, the HMP 20 restarts to form an image based on the position continuously calculated in the energy-saving mode.

<Terms>

The energy-saving mode is an operating mode of limiting a part of functions to suppress electric power consumption when the user does not use the HMP 20. The HMP 20 may have a plurality of energy-saving modes in accordance with degree of suppressing the electric power consumption. Specific functions restricted in the energy-saving mode will be described later. A function that ejects liquid droplets is limited in many cases.

The HMP 20 has a normal mode as an operating mode that is used in contrast with the energy-saving mode. The normal mode is an operating mode in which the functions including the function that ejects the liquid droplets are not restricted. According to the first embodiment, the HMP 20 has a power-ON standby state and a power-ON printing state as the normal mode in which the electric power consumption is not suppressed. Because the HMP 20 can form the image only in the power-ON printing state, only the power-ON printing state may be referred to as the normal mode, and the power-ON standby state may be included in the energy-saving mode.

A function (part) for calculating a position may be a necessary function (part) for calculating the position.

Further, the function for calculating the position may be a function required for calculating the position continuously after returning from the energy-saving mode. Specifically, navigation sensors 30 and a position calculating circuit 32, which will be described later, may be the function (part) that calculates the position. Further, a CPU 31 may be included in the function (part) for calculating the position because the CPU 31 is required for the overall control for returning.

Configuration Example

FIG. 1 is a block diagram illustrating an example of a hardware configuration of the HMP 20. The HMP 20 may be referred to as a liquid ejecting apparatus or an image forming apparatus that forms an image on the recording medium 12. The entire operation of the HMP 20 is controlled by a control unit 25. A communication IF 27, an IJ recording head driving circuit 23, an Operation panel Unit (OPU) 26, a Read Only Memory (ROM) 28, a Dynamic Random Access Memory (DRAM) 29, and the navigation sensors 30 are electrically coupled to the control unit 25. The HMP includes a power source 22 and a power source circuit 21 because the HMP 20 is driven by electric power. The electric power that the power source circuit 21 generates is supplied to the communication IF 27, the IJ recording head driving circuit 23, the OPU 26, the ROM 28, the DRAM 29, an IJ recording head 24, the control unit 25, and the navigation sensors through wires illustrated by dotted lines 22*a* or the like.

A battery is mainly used as the power source 22. A solar battery, a commercial power source (an alternating-current source), a fuel battery, or the like may be used. The power source circuit 21 allocates (transmits) the electric power, which the power source 22 supplies, to respective units (elements) of the HMP 20. Further, the power source circuit 21 increases or decreases a voltage of the power source 22 to a voltage appropriate for each unit. In a case where the power source 22 is a chargeable battery, the power source circuit 21 detects coupling of an AC source and couples the AC source to a charging circuit of the battery so that the power source 22 can be charged.

The communication IF 27 receives image data from an image data outputting device 11 such as a smartphone and a Personal Computer (PC). For example, the communication IF 27 is a communicating apparatus that can deal with communication standards such as a wireless LAN, Bluetooth (registered trade mark), Near Field Communication (NFC), infrared rays, 3G (portable phone), and Long Term Evolution (LED). Further, the communication IF 27 may be a communicating apparatus that can deal with wired communication using a wired LAN and a USB cable other than the wireless communication as described above.

The ROM 28 stores firmware for controlling hardware of the HMP 20, driving waveform data (data that defines a voltage change for ejecting liquid droplets) of the IJ recording head 24, initial setting data of the HMP 20, and the like. The ROM 28 is a non-volatile memory that can hold the stored contents even when the electric power is not supplied to the ROM 28.

The DRAM 29 may be used to store the image data received by the communication IF 27. The DRAM 29 may be used to store firmware developed (loaded) from the ROM 28. Accordingly, the DRAM 29 is used as a work memory of when the CPU 31 executes the firmware. The DRAM 29 is a volatile memory that loses the stored contents when the electric power is not supplied to the DRAM 29.

The navigation sensors 30 are sensors that detect a position of the HMP 20. For example, the navigation sensor 30 includes an imaging sensor that images (captures) the recording medium 12 and a light source such as a light-emitting diode (LED) and a laser. When the HMP 20 scans on the recording medium 12, minute edges of the recording medium 12 are detected (imaged) one after another and distances between the edges are analyzed to obtain a movement amount. The navigation sensors 30 are mounted on at least 2 places of the HMP 20. In other words, the HMP 20 has at least two navigation sensors. In a case of distinguishing the navigation sensors 30, the navigation sensors 30 are referred to as a navigation sensor S0 and a navigation sensor S1. Further, a multi-axis acceleration sensor, a gyro sensor and the like may be used as the navigation sensors 30. The position of the HMP 20 may be detected by only the acceleration sensor or the gyro sensor.

The OPU 26 includes a LED that displays a state of the HMP 20, a switch, and the like. The user uses the switch to instruct the HMP 20 to form an image. However, the OPU 26 is not limited to this. The OPU 26 may include a liquid crystal display. Further, the OPU 26 may include a touch panel. The OPU 26 may have a function that inputs sound (voice).

The IJ recording head driving circuit 23 uses the above described driving waveform data to generate a driving waveform (voltage) for driving the IJ recording head 24. The IJ recording head driving circuit 23 can generate the driving wave form in accordance with a size of an ink droplet and the like.

The IJ recording head 24 is a head for ejecting ink. The IJ recording head 24 can eject 4 colors inks, yellow, magenta, cyan, and black. However, a head that can eject 5 or more colors inks or a head that can eject single color ink may be used as the IJ recording head 24. A plurality of nozzles 61 are arranged for ejecting color inks. The nozzles 61 arranged in one or more lines may be arranged for each color. A method of ejecting ink may be a piezoelectric method, a thermal method, or another method.

Based on a movement amount that the navigation sensors 30 detect, the control unit 25 decides a position of each nozzle of the IJ recording head 24 and an image to be formed in accordance with the position. The control unit 25 will be described in detail next.

Figure 2:
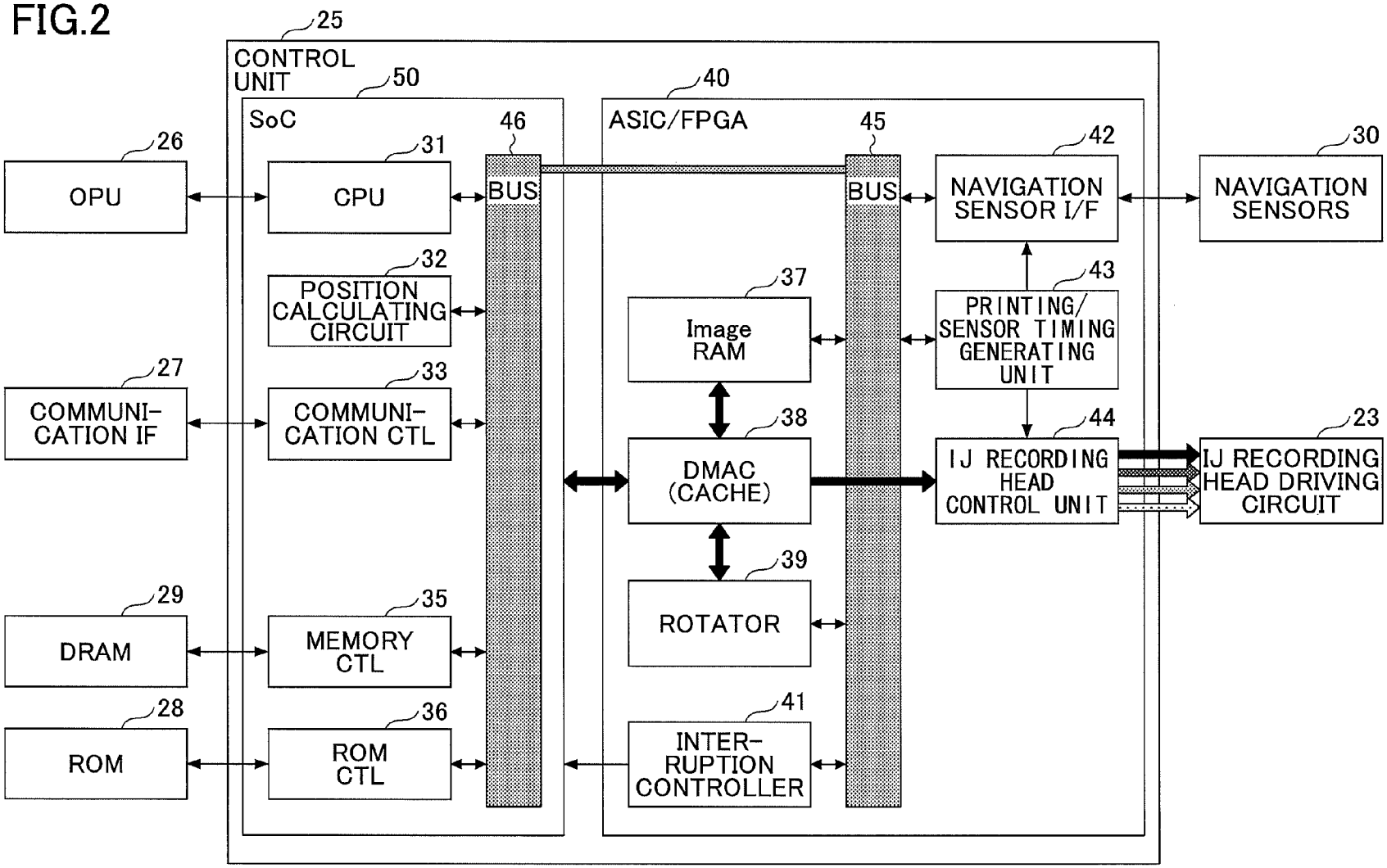
FIG. 2 is a block diagram illustrating an example of a configuration of a control unit according to the first embodiment.

FIG. 2 is a block diagram illustrating an example of a configuration of the control unit 25 according to the first embodiment. The control unit includes a System on Chip (SoC) 50 and an Application Specific Integrated Circuit/Field Programmable Gate Array 40 (ASIC/FPGA). The SoC 50 and the ASIC/FPGA 40 communicate via Buses 45 and 46. The ASIC/FPGA 40 may be designed by either a mounting technology of the ASIC or a mounting technology of the FPGA. The ASIC/FPGA 40 may be configured with another mounting technology other than the ASIC/FPGA 40. A chip of the SoC 50 does not have to be different from a chip of the ASIC/FPGA 40. The SoC 50 and the ASIC/FPGA 40 may be constituted with one chip or one substrate (base). Alternatively, the ASIC/FPGA 40 and the SoC 50 may be implemented by three or more chips or substrates (bases).

The SoC 50 has functions (elements) including a CPU 31, a position calculating circuit 32, a communication controller (CTL) 33, a memory controller CTL 35, a ROM controller (CTL) 36 that are coupled via the Bus 46. Here, configuration elements included in the SoC 50 are not limited to these.

The ASIC/FPGA 40 includes an Image RAM 37, a (Direct Memory Access Controller) DMAC 38, a rotator 39, an interruption controller 41, a navigation sensor I/F 42, a printing/sensor timing generating unit 43, and an IJ recording head control unit 44 that are coupled via the Bus 45. Here, configuration elements included in the ASIC/FPGA 40 are not limited to these.

The CPU 31 executes firmware (at least one program) developed (loaded) on the DRAM 29 from the ROM 28 to and controls operations of the position calculating circuit 32, the communication CTL 33, the memory CTL 35, and the ROM CTL 36 inside the SoC 50. Further, the CPU 31 controls operations of the Image RAM 37, the DMAC, the rotator 39, the interruption controller 41, the navigation sensor I/F 42, the printing/sensor timing generating unit 43, and the IJ recording head control unit 44 inside the ASIC/FPGA 40.

The position calculating circuit 32 calculates a position (coordinate information) of the HMP 20 based on a movement amount that the navigation sensors 30 detect for each sampling period. In other words, the position calculating circuit 32 may calculate the position of the HMP 20 relative to the recording medium 12. Although the position of the HMP 20 means positions of the nozzles 61 in a precise sense, the positions of the nozzles 61 can be calculated when the positions at which the navigation sensors 30 are located are recognized (found). In the first embodiment, although the positions of the navigation sensors 30 mean the positions of the nozzles 61 in a precise sense, the directly detected positions are the positions of the navigation sensors S0 and S1. In other words, the position of the HMP on the recording medium 12 may be detected by calculating the positions of the navigation sensors 30. The position calculating circuit 32 calculates a target ejection position for ejecting ink based on a predetermined resolution, which is 300 dpi, for example. Image data (pixels) in a predetermined range from the target ejection position is ejected.

For example, the positions of the navigation sensors 30 are calculated on the basis of a predetermined point of origin (initial position of the HMP 20 of when image formation is started) as described later. Further, the position calculating circuit 32 estimates a moving speed and a moving direction, based on a difference between a past position and a latest position, and predicts (calculates) a position in next calculation timing, for example. In this way, ink can be ejected while suppressing a delay with respect to scan of the user.

The communication CTL 33 controls the communication IF 27 to obtain image data. The memory CTL 35 is an interface with the DRAM 29. The memory CTL 35 requests data from the DRAM 29, transmits obtained firmware to the CPU 31, and transmits the obtained image data to the ASIC/FPGA 40.

The ROM CTL 36 is an interface with the ROM 28. The ROM CTL 36 requests data from the ROM 28 and transmits the obtained data to the CPU 31 and the ASIC/FPGA 40.

The rotator 39 rotates the image data, obtained by the DMAC 38, in accordance with the head that ejects ink, the nozzle position in the head, and inclination of the head due to a mounting error or the like. The DMAC 38 outputs the rotated image data to the IJ recording head control unit 44. For example, the rotator 39 can obtain a rotation angle θ calculated when the position calculating circuit 32 calculates a position. Then, the rotator 39 can use the obtained rotation angle θ to rotate a peripheral image.

The Image RAM 37 is a buffer memory that temporarily stores image data of a periphery of the nozzles 61 among the image data obtained by the DMAC 38. Because the image data on the periphery of the nozzles 61 is buffered, a temporal delay until the DMAC 38 reads out the image data can be reduced even when the position of the nozzles 61 changes.

The IJ recording head control unit 44 performs dither processing or the like on the image data (bitmap data) to convert the image data into a set (group) of points representing the image with a size and density. Thus, the image data is chanted to the data on the sizes of points and ejection positions. The IJ recording head control unit 44 outputs, to the IJ recording head driving circuit 23, a control signal in accordance with the size of the points. Using the driving waveform data corresponding to the control signal as described above, the IJ recording head driving circuit 23 generates a driving waveform (voltage). Here, the dither processing or the like may be performed before the data is stored in the Image RAM 37.

The navigation sensor I/F 42 communicates with the navigation sensors 30 to receive movement amounts ΔX' and ΔY', which will be described later, from the navigation sensors 30 as information. The navigation sensor I/F 42 stores the received values in an internal register.

The printing/sensor timing generating unit 43 notifies the navigation sensor I/F 42 of timing of reading the information of the navigation sensors 30 and notifies the IJ recording head control unit 44 of driving timing. The IJ recording head control unit determines to eject ink when the target ejection position is located within a predetermined distance from the position of the nozzles 61. The IJ recording head control unit 44 determines not to eject ink when the target ejection position is not located.

The interruption controller 41 detects that the communication between the navigation sensor I/F and the navigation sensors 30 is completed, and outputs an interruption signal for notifying the SoC that the communication between the navigation sensor I/F 42 and the navigation sensors 30 is completed. Based on the interruption, the CPU 31 obtains ΔX' and ΔY' that the navigation sensor I/F 42 stores in the internal register. In addition, the interruption controller 41 may also have a function that notifies status such as an error.

<Functions Relating to Energy-Saving Control>

Figure 3:
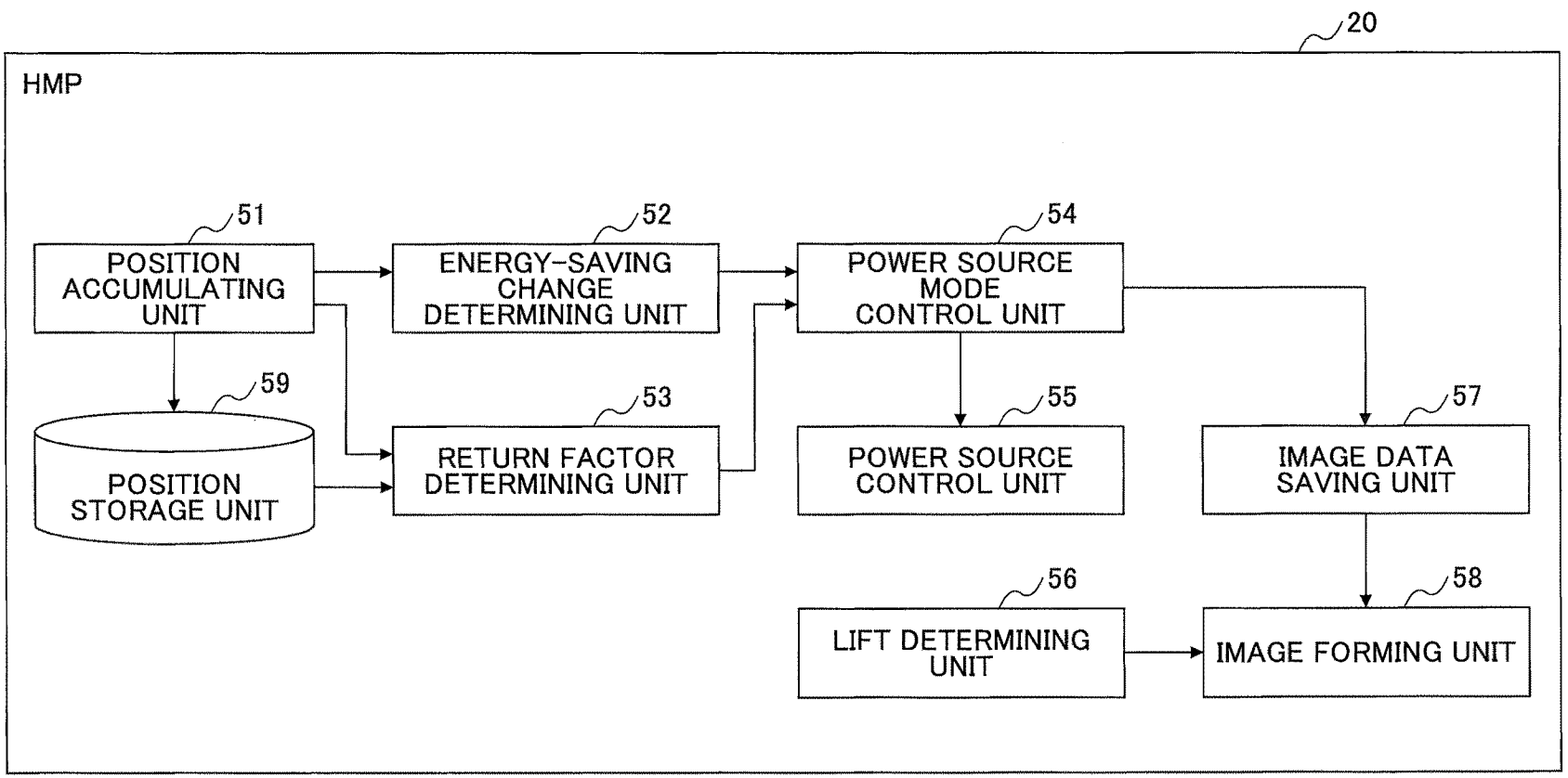
FIG. 3 is a block diagram illustrating an example of functions relating to energy-saving control according to the first embodiment.

FIG. 3 is a block diagram illustrating an example of functions relating to energy-saving control according to the first embodiment. The HMP includes a position accumulating unit 51, an energy-saving change determining unit 52, a return factor determining unit 53, a power source mode control unit 54, a power source control unit 55, a lift determining unit 56, an image data saving unit 57, and an image forming unit 58 that are relating to the energy-saving control. These functional units (elements) are functions or units realized by the CPU of the control unit 25 executing one or more programs developed (loaded) from the ROM 28 on the DRAM 29.

The HMP 20 includes a position storage unit 59. For example, the position storage unit 59 may be structured with the DRAM 29. The position storage unit 59 may be structured with the ROM 28.

The position accumulating unit 51 obtains the position(s) that the position calculating circuit 32 detects. The position accumulating unit 51 stores, in the position storage unit 59, the obtained position(s) together with time information (clock time information). The time information may be an absolute time (time of day), or an elapsed time from when the HMP 20 is powered ON.

The position storage unit 59 stores the position and the time information that the position accumulating unit 51 causes the position storage unit to store. The position storage unit 59 holds (stores) time information and a position in a predetermined past time as a pair. A latest position and latest time information are always stored because the position and the time information are overwritten on an older position and older time information. The position storage unit 59 maintains the stored contents in the normal mode. The position storage unit 59 may maintain the stored contents in the energy-saving mode.

The energy-saving change determining unit 52 determines whether a change condition for changing to an energy-saving mode 1, which will be described later, is satisfied in a power-ON standby state. The energy-saving change determining unit 52 determines whether a change condition for changing to an energy-saving mode 2, which will be described later, is satisfied in a power-ON printing state. In a case where the change condition is satisfied, the energy-saving change determining unit 52 notifies the power source mode control unit 54.

The return factor determining unit 53 determines whether a return factor is detected. In a case where the return factor is detected, the return factor determining unit 53 notifies the power source mode control unit 54. For example, the return factor is that the OPU 26 is operated, the communication IF 27 receives a print job, or the navigation sensors 30 detect a movement. Using interruption detection that the HMP 20 has, the return factor determining unit 53 detects these return factors.

When the change condition for changing to the energy-saving mode 1 is satisfied, the power source mode control unit 54 changes the state of the HMP 20 to the energy-saving mode 1 from the power-ON standby state. When the change condition for changing to the energy-saving mode 2 is satisfied, the power source mode control unit 54 changes the state of the HMP 20 to the energy-saving mode 2 from the power-ON printing state. Further, when the return factor is detected, the power source mode control unit 54 returns the state of the HMP 20 from the energy-saving mode 1 to the power-ON standby state or returns the state of the HMP 20 from the energy-saving mode 2 to the power-ON printing state.

Depending on which operating mode of the normal mode, the energy-saving mode 1, the energy-saving mode 2, the power-ON standby state, or the power-ON printing state controlled, the power source control unit 55 turns ON/OFF electric power that the power source circuit supplies to each block (element) illustrated in FIGS. 1 and 2. In other words, based on an operating mode of the HMP 20 selected from the normal mode, the energy-saving mode 1, the energy-saving mode 2, the power-ON standby state, and the power-ON printing state, the power source control unit 55 may individually supply the electric power to the blocks illustrated in FIGS. 1 and 2. Further, not only turning ON/OFF, the power source control unit 55 may turn ON/OFF electric power to a part of functions. Furthermore, the power source control unit 55 may reduce an operating frequency, which a crystal oscillator generates, at the time of the energy-saving mode and return the reduced operating frequency to the operating frequency before reduced at the time of the normal mode.

The lift determining unit 56 detects that the navigation sensors 30 cannot detect the position, the position that the navigation sensors 30 detects changes greater than a threshold value, and an abnormal value is output. Thereby, the lift determining unit 56 determines that the HMP 20 is lifted from the recording medium 12. That is, because a distance between the navigation sensors 30 and the recording medium 12 increases, the lift determining unit 56 detects that the navigation sensors 30 cannot detect the position normally. In other words, when a distance from the recording medium 12 to at least one of the navigation sensors 30 becomes greater than a predetermined distance, the lift determining unit 56 may determine that the navigation sensors 30 cannot detect the position accurately because the HMP 20 is lifted from the recording medium 12.

The image data saving unit 57 saves the image data and the like of the DRAM 29 to the ROM 28 at the time of changing from the normal mode to the energy-saving mode. The image data saving unit 57 develops (loads) the image data and the like of the ROM 28 on the DRAM 29 at the time of returning from the energy-saving mode to the normal mode.

Based on the position that the position calculating circuit 32 detects, the image forming unit 58 performs control to cause the IJ recording head 24 to eject ink corresponding to image data of the target ejection position(s) located in a predetermined range from coordinates of the nozzles.

<Nozzle Position in IJ Recording Head>

Figure 4A:
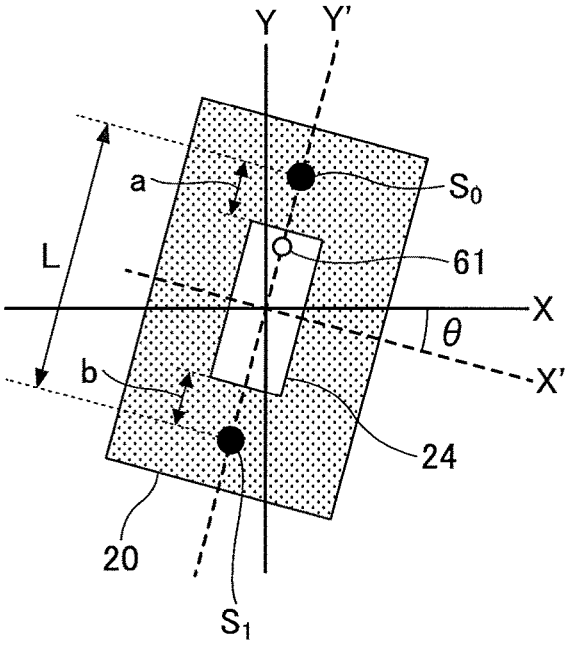
FIGS. 4A and 4B are diagrams that describe an example of a nozzle position in an IJ recording head according to the first embodiment.
Figure 4B:
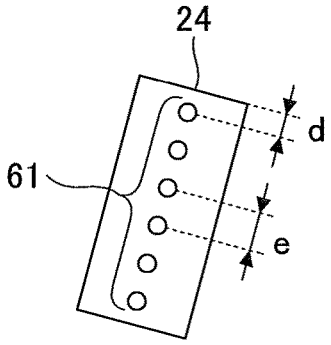

A nozzle position and the like in the IJ recording head 24 and the like will be described with reference to FIGS. 4A and 4B. FIG. 4A is an example of a plan view of the HMP 20. FIG. 4B is a drawing that describes only the IJ recording head 24. The illustrated surface is a surface that faces the recording medium 12.

The HMP 20 according to the first embodiment includes two or more navigation sensors 30. Because the HMP 20 has two or more navigation sensors 30, the navigation sensors 30 can detect a rotation angle θ even when the navigation sensors 30 rotate relative to the HMP 20 during forming the image. The two navigation sensors S0 and S1 are arranged away from each other in an arrangement direction of the nozzles 61 in FIG. 4A. Here, a distance L represents a length between the two navigation sensors S0 and S1. The distance L is preferably as long as possible. This is because, as the distance L becomes longer, a minimum rotation angle θ that can be detected is decreased and an error of the position of the HMP 20 is decreased.

A distance from the navigation sensor S0 to the IJ recording head 24 is a distance a. A distance from the navigation sensor S1 to the IJ recording head 24 is a distance b. The distance a and the distance b may be equal to each other. As illustrated in FIG. 4B, a distance d is a distance from an edge of the IJ recording head 24 to the first nozzle 61, and a distance e is a distance between adjacent nozzles. Values a to e are stored in the ROM 28 or the like in advance.

Accordingly, when the position calculating circuit 32 or the like calculates positions of the navigation sensors 30, the position calculating circuit 32 can detect positions of the nozzles 61 by use of the distance a, the distance b, the distance d, and the distance e.

In the first embodiment, a direction horizontal to the recording medium 12 is X axis, and a direction perpendicular to the recording medium 12 is Y axis. These coordinates are referred to as recording medium coordinates. On the other hand, the navigation sensors 30 detect an amount of change of the position in the following coordinate axes (X' axis and Y' axis). That is, the arrangement direction of the nozzles 61 (direction connecting the two navigation sensors S0 and S1) is Y' axis. A direction orthogonal to Y' axis is X' axis. The positions are calculated by the position calculating circuit 32.

<Position of HMP in Recording Medium>

Figure 5A:
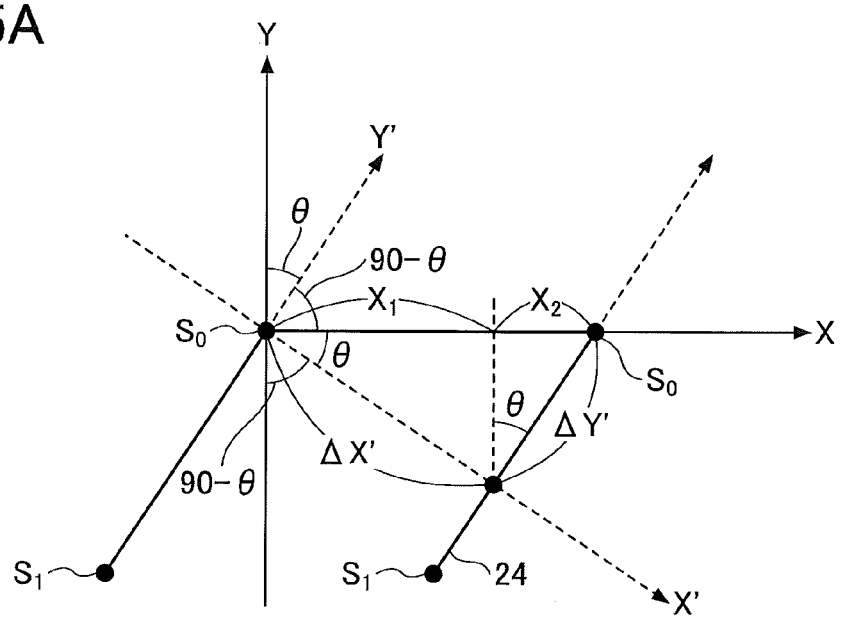
FIGS. 5A and 5B are diagrams that describe an example of calculation of a position of the HMP according to the first embodiment.

Calculation of the position of the HMP 20 will be described with reference to FIG. 5. In FIG. 5A, the HMP 20 rotates by rotation angle θ in a clockwise fashion relative to the recording medium 12. If the HMP 20 does not rotate at all, X=X' and Y=Y'. However, in a case where the HMP 20 rotates by the rotation angle θ relative to the recording medium 12, output of the navigation sensors S0 and S1 does not match an actual position of the HMP 20 on the recording medium 12.

Thus, as illustrated in FIG. 5A, ΔX' and ΔY' that the navigation sensors S0 and S1 output correspond to X and Y of the recording medium coordinates as follows. FIG. 5A illustrates correspondence of X and Y to movement amounts ΔX' and ΔY' that the navigation sensors S0 and S1 (outputs are equal because of parallel movement) detect in a case where the HMP 20 having the rotation angle θ moves in only X direction while keeping the rotation angle θ. Here, ΔX', which the navigation sensors S0 and S1 output, is reflected in X1, and ΔY', which the navigation sensors S0 and S1 output, is reflected in X2.

Figure 5B:
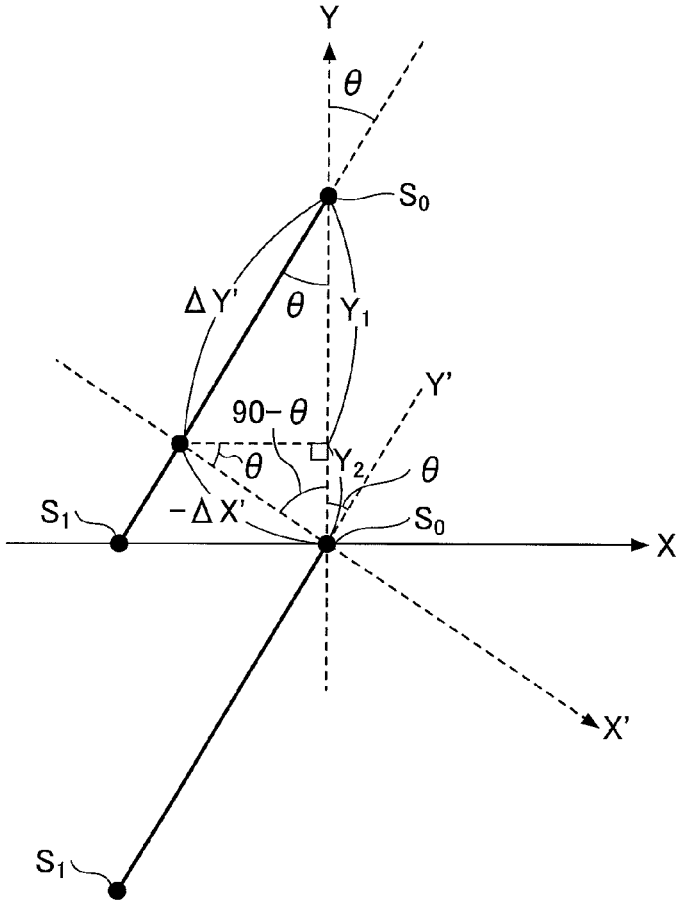

FIG. 5B illustrates correspondence of X and Y to movement amounts ΔX' and ΔY' that the navigation sensors S0 and S1 (outputs are equal because of parallel movement) detect in a case where the HMP 20 having the rotation angle θ moves in only Y direction while keeping the rotation angle θ. Here, ΔY', which the navigation sensors S0 and S1 output, is reflected in Y1, and −ΔX', which the navigation sensors S0 and S1 output, is reflected in Y2.

Accordingly, in a case where the HMP 20 moves in X direction and Y direction while having the rotation angle θ, ΔX' and ΔY', which the navigation sensors S0 and S1 output, can be converted to X and Y of the recording medium coordinates as follows.

$$X=\Delta X' \cos\theta+\Delta Y' \sin\theta \quad (1)$$

$$Y=-\Delta X' \sin\theta+\Delta Y' \cos\theta \quad (2)$$

Thus, when the starting position of the image formation is regarded as the base point and the rotation angle θ is recognized (found), the positions of the navigation sensors S0 and S1 of the recording medium coordinates can be calculated from the above formulas (1) and (2). The starting position of the image formation is a position at which the image formation is started when the user pushes a button or the like of the HMP 20. For example, the starting position of the image formation is a slightly inner side position with respect to a left top corner of the recording medium 12.

Here, rotation angle dθ in sampling time of ΔX' and ΔY' can be calculated, as follows, from a difference between outputs (ΔX'0, ΔX'1) of the two navigation sensors S0 and S1.

$$d\theta=\arcsin\{(\Delta X'0-\Delta X'1)/L\} \quad (3)$$

<State Transition>

Figure 6:
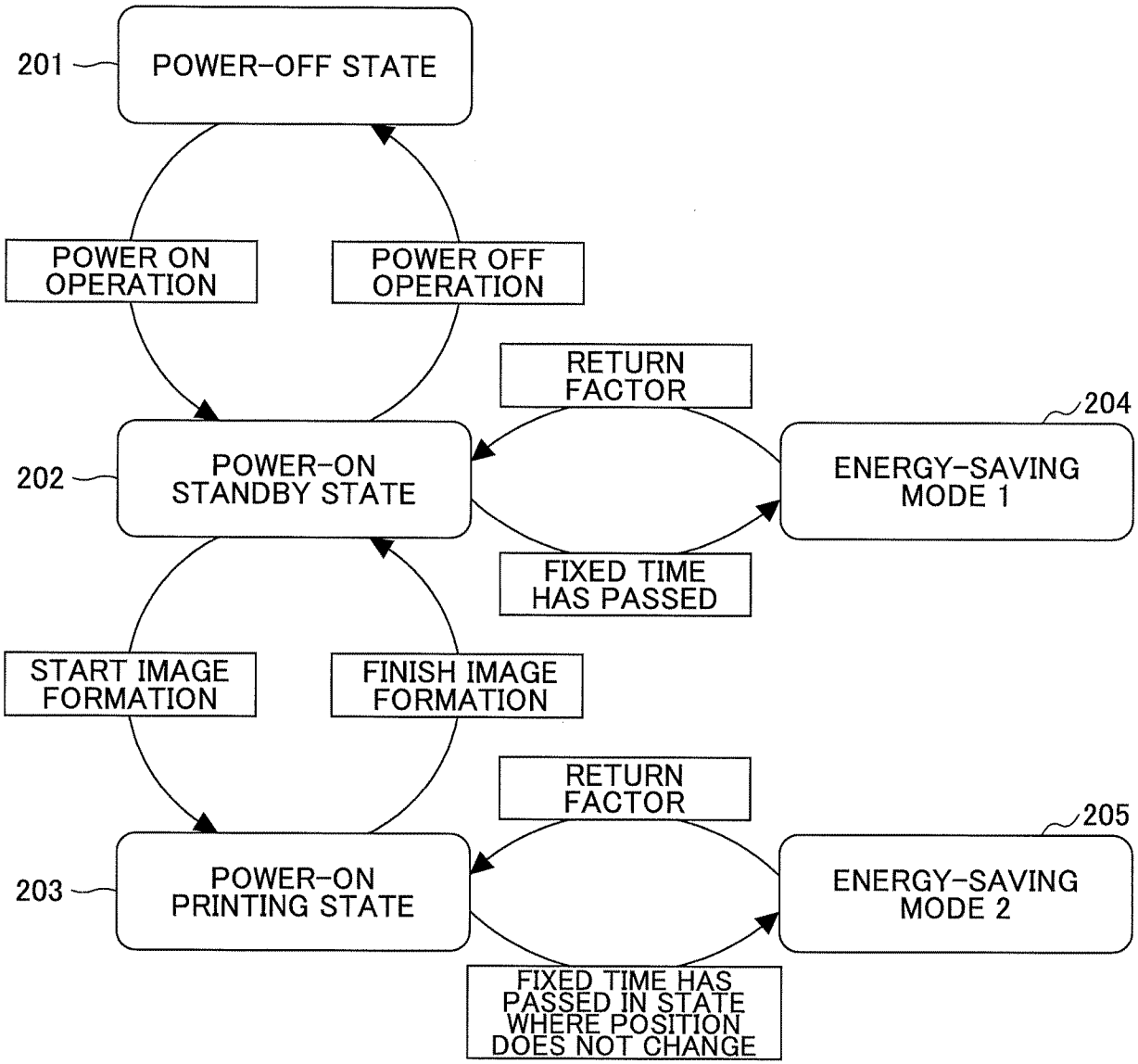
FIG. 6 is an example of a state transition diagram relating to electric power states of the HMP according to the first embodiment.

FIG. 6 is an example of a state transition diagram relating to electric power states of the HMP 20.

The HMP 20 has a power OFF state 201, a power-ON standby state 202, a power-ON printing state 203, the energy-saving mode 1 (reference numeral 204), and the energy-saving mode 2 (reference numeral 205) as electric power status. In the following descriptions, reference numerals are omitted. The power OFF state is an electric power state in which the power source switch is OFF and electric power is not consumed. The power-ON standby state is an electric power state in which operations except for image formation can be performed. The power-ON printing state is an electric power state in which all operations including the image formation can be performed. The energy-saving mode 1 is an electric power state whose electric power consumption is lower than an electric power consumption of the power-ON standby state. The energy-saving mode 2 is an electric power state whose electric power consumption is lower than an electric power consumption of the power-ON printing state.

When the user performs an operation to turn on the power in the power OFF state, the HMP 20 changes to be in the power-ON standby state. When the user performs an operation to turn off the power in the power-ON standby state, the HMP 20 changes to be in the power-OFF state. When the image formation is started in the power-ON standby state, the HMP 20 changes to be in the power-ON printing state. When the image formation is finished in the power-ON printing state, the HMP 20 changes to be in the power-ON standby state. When a predetermined time has passed while not being moved in the power-ON standby state, the HMP 20 changes to be in the energy-saving mode 1. When a return factor is detected in the energy-saving mode 1, the HMP 20 changes to be in the power-ON standby state. When a predetermined time has passed while not being moved in the power-ON printing state, the HMP 20 changes to be in the energy-saving mode 2. When a return factor is detected in the energy-saving mode 2, the HMP 20 changes to be in the power-ON printing state. Details of the return factor and the like will be described later.

<Operating Procedure>

Figure 7:
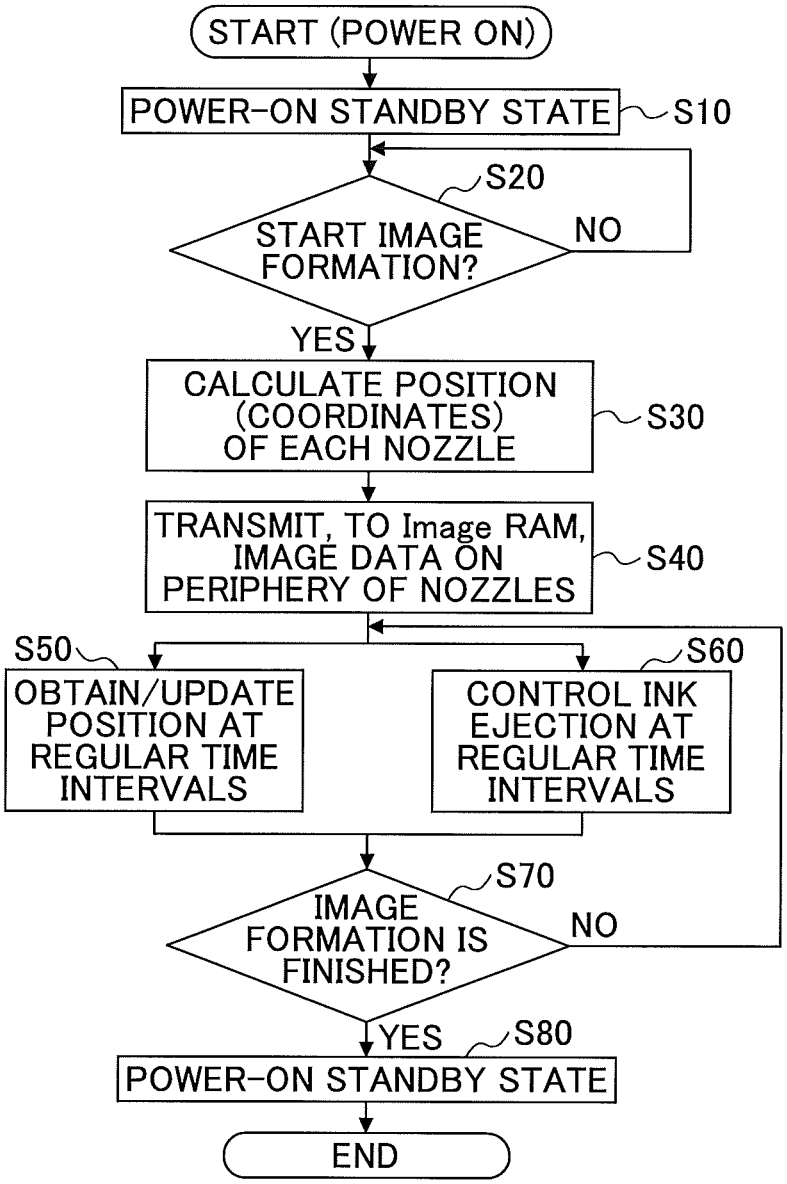
FIG. 7 is a flowchart illustrating an example of a procedure from starting image formation to finishing the image formation in a case of not changing to an energy-saving mode.

Processing of the HMP 20 during forming an image will be described with reference to FIG. 7. FIG. 7 is a flowchart illustrating an example of a procedure from starting image formation to finishing the image formation in a case of not changing to the energy-saving mode. The processing of FIG. 7 starts when the power source of the HMP 20 is turned ON. It should be noted that the procedure of FIG. 7 is a procedure of a comparative example for descriptions in comparison with the first embodiment.

In step S10, the HMP 20 enters the power-ON standby state when the power is turned on as illustrated in FIG. 6.

The HMP 20 determines whether to start to form an image in step S20. For example, when the user decides the initial position of the HMP 20 on the recording medium 12 (notebook, for example) and pushes an image formation starting button, the image formation is started. Thus, the state of the HMP 20 becomes the power-ON printing state. Here, a factor for changing to the power-ON printing state from the power-ON standby state is not limited to the user operation. For example, in response to completely receiving image data transmitted from the image data outputting device 11, the HMP 20 may change to be in the power-ON printing state from the power-ON standby state.

In a case where the HMP 20 determines to start to form the image (YES in step S20), the position calculating circuit 32 starts to calculates the position in step S30. A position immediately after entering the power-ON printing state is the initial position, and coordinates of an upper-left nozzle (a plurality of lines of nozzles are arranged for color printing, high speed printing, and the like) are coordinates (0, 0), for example. After that, the user freely causes the HMP 20 to scan (moves the HMP 20 freehand) on the recording medium to form the image on the recording medium 12. When entering the power-ON printing state, the CPU 31 notifies the navigation sensor I/F 42 in the ASIC/FPGA 40 so as to obtain the movement amount from the navigation sensors 30. The navigation sensors 30 detect the movement amount and output the movement amount to the navigation sensor I/F 42. For example, the navigation sensors 30 may output ΔX' and ΔY'. The position calculating circuit 32 obtains the movement amount from the navigation sensor I/F 42 to calculate a position (coordinates) of each nozzle of the IJ recording head 24 from a relationship, determined in advance, between a mounted position of the IJ recording head 24 and mounted positions of the navigation sensors 30.

Next, the DMAC 38 in the ASIC/FPGA 40 causes the memory CTL 35 to read out the image data on the periphery of the IJ recording head 24 (each nozzle) from the DRAM 29 based on the position of each nozzle, and transmits the image data to the Image RAM 37 in step S40. Here, the rotator 39 rotates the image data in accordance with the position/inclination of the IJ recording head 24.

Next, in step S50, the HMP 20 repeatedly calculates and updates positions of the nozzles at regular time intervals (at predetermined time intervals). For example, this regular time interval may be several milliseconds (ms) (from 1 millisecond to several milliseconds, for example). The regular time interval may be a longer interval or a shorter interval than the several seconds. However, the regular time interval may be preferably as short as possible in consideration of a processing load and the like.

In step S60, in parallel with calculating and updating the position, the HMP 20 repeats, at regular time intervals, processing of ejecting ink based on the image data (of the target ejection positions in the predetermined range from the positions of the nozzles) that matches the positions of the nozzles. For example, this regular time interval may be several tens of microseconds (μs) (from several tens of microseconds to several hundreds of microseconds, for example). The regular time interval may be a longer interval or a shorter interval than the several tens of microseconds (μs). However, the regular time interval may be preferably as short as possible in consideration of a processing load and the like. The regular time interval of step S60 is shorter than the regular time interval of step S50 because the position calculating circuit 32 can predict, based on the past positions, the positions of the nozzles until position information is updated next.

The processing of steps S50 and S60 is repeated until the image formation is finished. While performing the processing of steps S50 and S60, the CPU 31 determines whether the image formation is finished in step S70. For example, when formation of all image data is completed, it is detected that the image formation is finished. However, in a case where the user pushes an image formation completing button, the image formation is also finished.

When the image formation is finished (YES in step S70), the state of the HMP 20 returns to the power-ON standby state in step S80.

<<Processing of Changing/Returning to/from the Energy-Saving Mode 1 in the Power-ON Printing State>>

Figure 8:
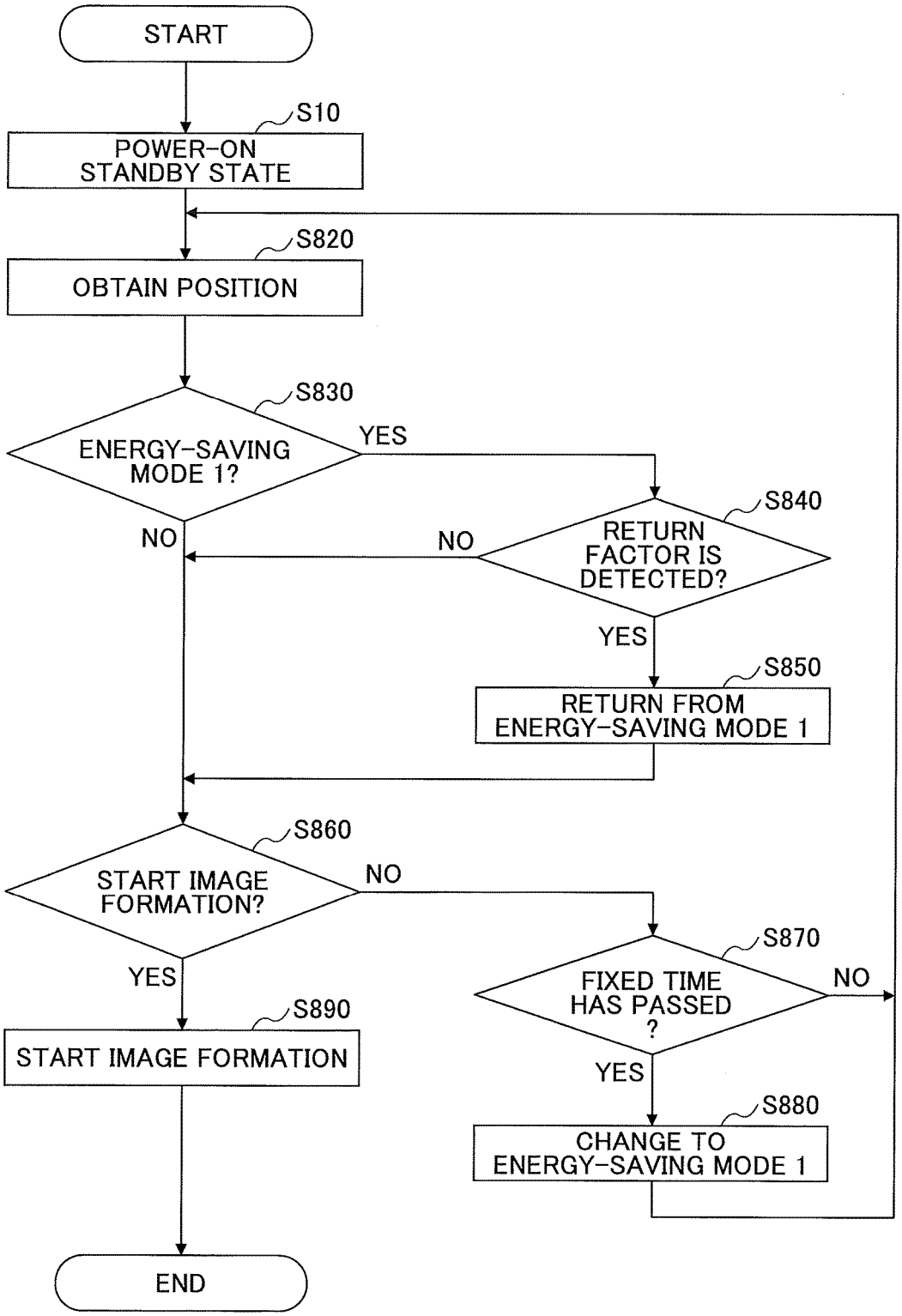
FIG. 8 is a flowchart illustrating an example of a procedure of changing to the energy-saving mode 1 and a procedure of returning from the energy-saving mode 1 in a power-ON standby state according to the first embodiment.

Processing of changing/returning to/from the energy-saving mode 1 in the power-ON printing state will be described with reference to FIG. 8. FIG. 8 is a flowchart illustrating an example of a procedure of changing to the energy-saving mode 1 and a procedure of returning from the energy-saving mode in the power-ON standby state according to the first embodiment. The processing of FIG. 8 starts when the power source of the HMP 20 is turned ON.

In step S10, the state of the HMP 20 becomes the power-ON standby state when the power source is turned ON. That is, the power source mode control unit 54 changes the HMP 20 to be in the power-ON standby state.

When entering the power-ON standby state, the position accumulating unit 51 starts to obtain the position in step S820. Coordinates of the position immediately after entering the power-ON standby state are coordinates (0,0). The position accumulating unit 51 stores the position, detected by the position calculating circuit 32, together with the time information in the position storage unit 59.

Next, the power source mode control unit 54 determines in step S830 whether a current operating mode is the energy-saving mode 1 so as to be able to change from the energy-saving mode 1 to the power-ON standby state.

In a case where the power source mode control unit 54 determines that the current operating mode is the energy-saving mode 1 (YES in step S830), the return factor determining unit 53 determines whether a return factor is detected in step S840. For example, the return factor is that the OPU 26 is operated, the communication IF 27 receives a print job, or the navigation sensors 30 detect a movement.

In a case where the return factor determining unit 53 determines that the return factor is detected (YES in step S840), the power source mode control unit 54 returns the operating mode from the energy-saving mode 1 to the power-ON standby state in step S850.

In a case where the power source mode control unit 54 determines that the return factor is not detected (NO in step S830), the HMP 20 determines whether to start the image formation in step S860 because the HMP 20 is in the normal mode.

In a case where the HMP 20 determines not to start the image formation (NO in step S860), the power source mode control unit 54 determines in step S870 whether a fixed time has passed after the HMP 20 enters the power-ON standby state.

In a case of determining that the fixed time has passed (YES in step S870), the power source mode control unit 54 changes the state of the HMP 20 to the energy-saving mode 1 S880 because the fixed time has passed while the HMP 20 keeps in the power-ON standby state. After that, the processing proceeds to step S820.

In a case of determining that the fixed time has not passed (NO in step S870), the processing returns to step S820 and is repeatedly executed from obtaining the position.

In a case where the HMP 20 determines to start the image formation (YES in step S860), the image forming unit 58 starts the image formation in step S890. Then, because the power source mode control unit 54 changes the state of the HMP 20 to the power-ON printing state, the processing of changing/returning to/from the energy-saving mode 1 in the power-ON standby state ends. Using the position stored in the position storage unit 59, the image forming unit 58 forms the image. Coordinates of a starting position of the image formation are coordinates (0,0) when the image formation is performed without changing to the energy-saving mode 1. Even when returning from the energy-saving mode 1, because the position of the nozzles 61 is coordinates (0,0) in a case of changing to the energy-saving mode 1 before entering the power-ON printing state, the position of when the image forming unit 58 starts to form the image is coordinates (0,0).

In this way, when the fixed time has passed in a state where the image formation is not started in the power-ON standby state, the HMP 20 changes to be in the energy-saving mode 1. Thereby, it is possible to prevent wasteful electric power consumption of the HMP 20. Further, even when changing to the energy-saving mode 1 in the power-ON standby state, it is possible to form the image at the time of return.

<<Changing/Returning to/from the Energy-Saving Mode 2 in the Power-ON Printing State>>

Figure 9:
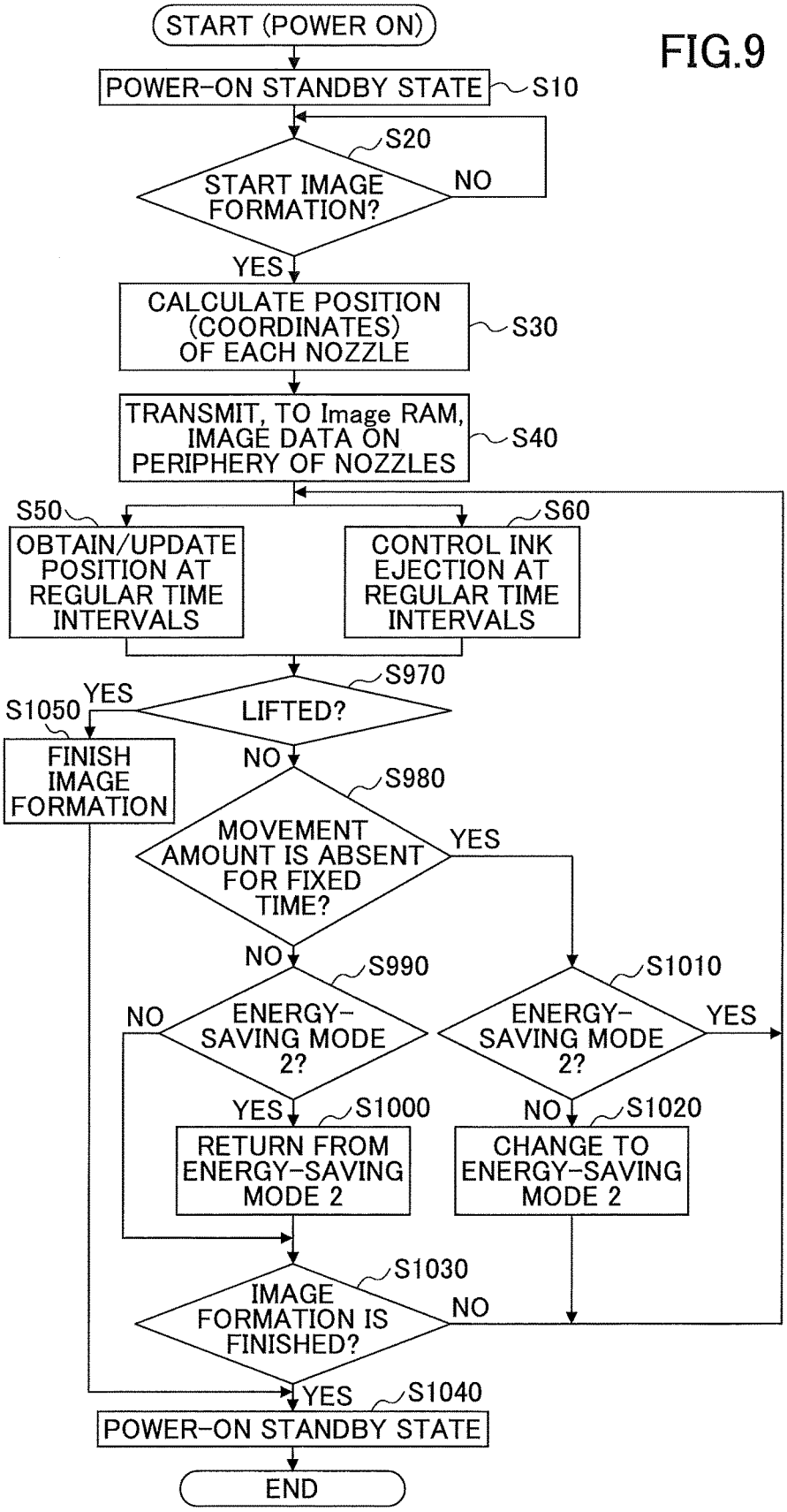
FIG. 9 is a flowchart illustrating an example of a procedure of changing to an energy-saving mode 2 and a procedure of returning from the energy-saving mode 2 in a power-ON printing state according to the first embodiment.

Processing of changing/returning to/from the energy-saving mode 2 in the power-ON printing state will be described with reference to FIG. 9. FIG. 9 is a flowchart illustrating an example of a procedure of changing to the energy-saving mode 2 and a procedure of returning from the energy-saving mode in the power-ON printing state according to the first embodiment. The processing of FIG. 9 starts when the power source of the HMP 20 is turned ON. Differences between the processing of FIG. 9 and the processing of FIG. 7 will be mainly described.

The processing of steps S10 to S60 of FIG. 9 may be similar to the processing of steps S10 to S60 of FIG. 7. In FIG. 9, subsequent so step S50 or S60, the lift determining unit 56 determines in step S970 whether the HMP 20 is lifted (raised).

In a case where the lift determining unit 56 determines that the HMP 20 is lifted (YES in step S970), the image forming unit 58 finishes the image formation in step S1050 because the lifting is detected.

In a case where the lift determining unit 56 determines that the HMP 20 is not lifted (NO in step S970), the energy-saving change determining unit determines in step S980 whether a fixed time has passed while the HMP 20 does not move. In a case where the position does not change for the fixed time with respect to the time information stored in the position storage unit 59, the energy-saving change determining unit 52 determines that the fixed time has passed while the HMP 20 does not move (YES in step S980). For example, the fixed time (time period) may be a time (time period) during which it is determined that the user is not using the HMP 20 and may be 1 minute. The user may set an arbitrary time as the fixed time from the OPU 26 or the image data outputting device 11.

In a case where the energy-saving change determining unit 52 determines that the fixed time has not passed while the HMP 20 does not move (NO in step S980), the power source mode control unit 54 determines whether a current operating mode is the energy-saving mode 2 in step S990 because the HMP 20 is moved.

In a case where the power source mode control unit 54 determines that the current operating mode is the energy-saving mode 2 (YES in step S990), the return factor determining unit 53 detects the return factor and the power source mode control unit returns the operating mode from the energy-saving mode 2 to the power-ON printing state in step S1000 because the HMP 20 is moved in the energy-saving mode 2. As described later, because the electric power is supplied to the navigation sensors 30 and the position calculating circuit 32 in the energy-saving mode 2, the image forming unit 58 can use the position to restart the image formation. In other words, when it is detected, by the position of HMP 20 calculated by the position calculating circuit 32, that the HMP 20 is moved in the energy-saving mode 2, the return factor determining unit 53 detects the return factor for returning the state of the HMP 20 to the power-ON printing state from the energy-saving mode 2. When the state of the HMP 20 returns to the power-ON standby state from the energy-saving mode 2, the image forming unit 58 of the HMP 20 can restart to eject ink based on the position that has been calculated by the position calculating circuit 32 in the energy-saving mode 2.

In a case where the energy-saving change determining unit 52 determines that the fixed time has passed while the HMP 20 does not move (YES in step S980), the power source mode control unit 54 determines whether a current operating mode is the energy-saving mode 2 in step S1010 because the HMP 20 is not moved.

In a case where the power source mode control unit 54 determines that the current operating mode is the energy-saving mode 2 (YES in step S1010), the processing returns to step S50 or S60 because the HMP 20 is not moved and the operating mode is the energy-saving mode 2 already. Accordingly, the determination for lifting is performed even in the state of the energy-saving mode 2. In other words, the processing in step S970 is performed even in the energy-saving mode 2.

In a case where the power source mode control unit 54 determines that the current operating mode is not the energy-saving mode 2 (NO in step S1010), the energy-saving change determining unit 52 determines to change the operating mode to the energy-saving mode 2 and the power source mode control unit 54 changes the operating mode from the power-ON printing state to the energy-saving mode 2 in step S1020 because the HMP 20 is not moved and the operating mode is not the energy-saving mode 2. In other words, the energy-saving change determining unit 52 may determine to change the state of the HMP to the energy-saving mode 2 from the power-ON printing state in a case where the position calculated by the position calculating circuit 32 does not change for a time longer than a predetermined time and the position is regarded as constant.

Subsequent to steps S990 and S1000, the image forming unit 58 determines whether the image formation is finished in step S1030.

When the image formation is finished (YES in step S1030), the power source mode control unit 54 changes the HMP 20 to be in the power-ON standby state in step S1040.

According to the returning/changing processing as described above, in a case where the state of the HMP 20 changes to the energy-saving mode during forming the image in the power-ON printing state, the HMP 20 can restart to form the image from the stopped position when returning. Further, because the HMP 20 can change to the power-ON standby state by being lifted in the energy-saving mode 2 and the HMP 20 can change to the energy-saving mode 1 from the power-ON standby state, it becomes easy to suppress waste of the electric power though it depends on the electric power consumption state of the power-ON standby state and the electric power consumption state of the energy-saving mode 1.

<Electric Power Supplying State in the Energy-Saving Mode 1>

Figure 10A:
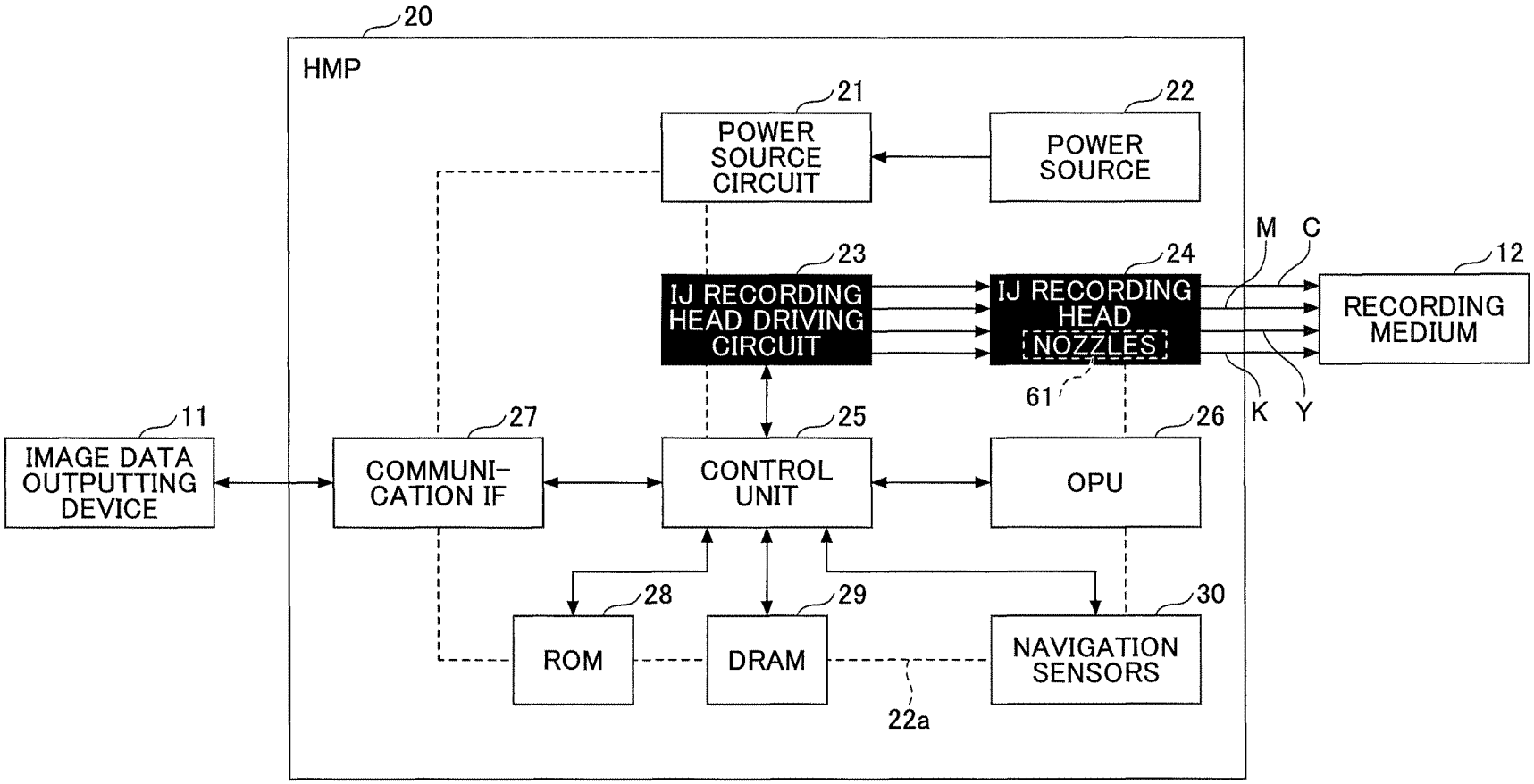
FIG. 10A is a block diagram illustrating an example of an electric power consumption state of the power-ON standby state according to the first embodiment.

An electric power consumption state of the power-ON standby state will be described with reference to FIG. 10A. Here, each hardware element illustrated in FIGS. 1 and 2 is referred to as a block for convenience of descriptions. FIG. 10A is a block diagram illustrating an example of the electric power consumption state of the power-ON standby state. In the following descriptions, black painted blocks represent the blocks in a non-operating state in which the electric power is not consumed at all or is not almost consumed. Slashed blocks represent the blocks in a power-saving operating state in which the electric power consumption is smaller than a normal state. Blocks, which are not the slashed blocks and not the black painted blocks, represent the blocks in the normal electric power supplying state.

In the power-ON standby state, the IJ recording head driving circuit 23 and the IJ recording head 24 are in the non-operating state and other blocks are in the normal state.

Figure 10B:
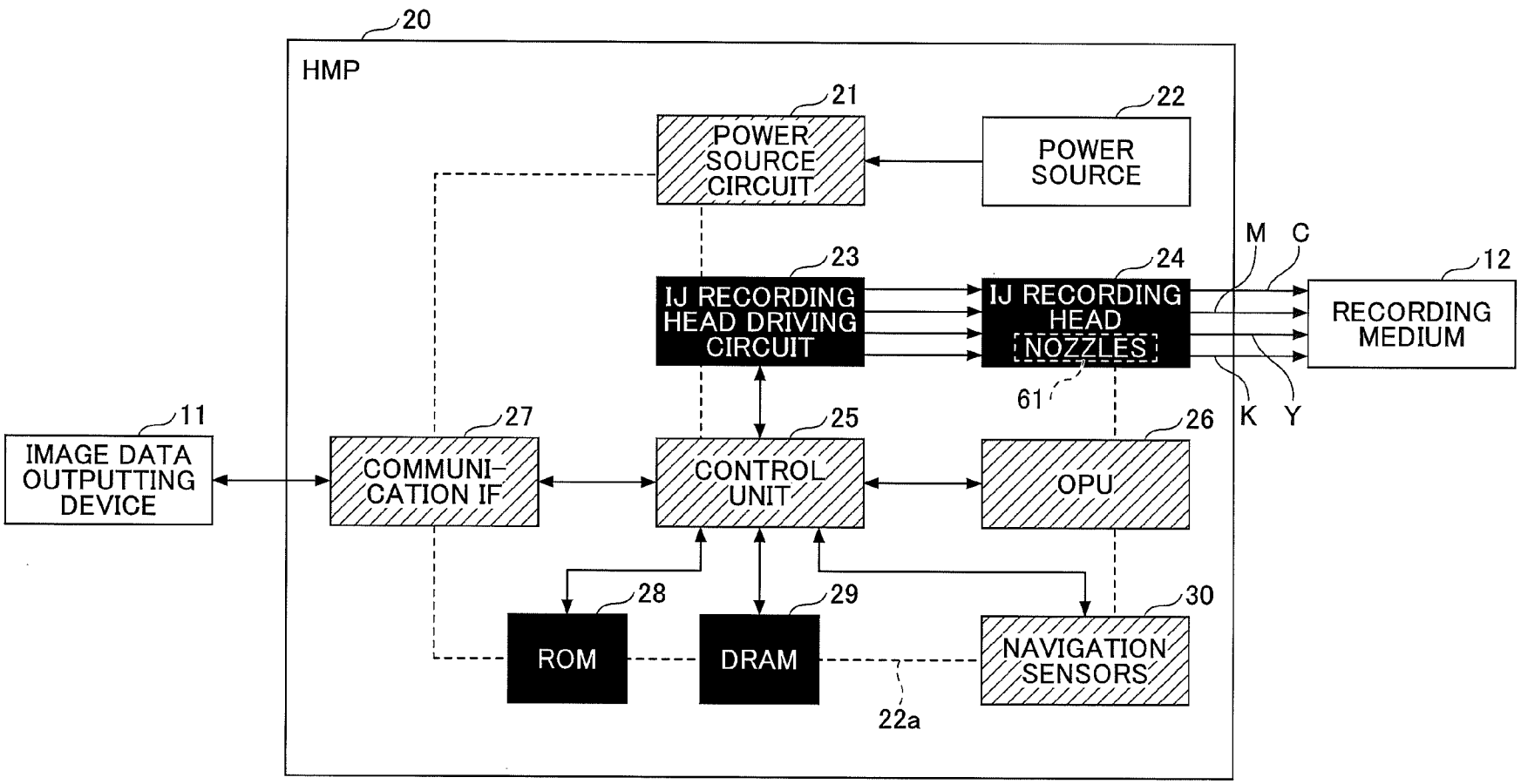
FIG. 10B is a block diagram illustrating an example of an electric power consumption state of the energy-saving mode 1 according to the first embodiment.

FIG. 10B is a block diagram illustrating an example of the electric power consumption state of the HMP 20 in the energy-saving mode 1. The power source circuit 21 is in the power-saving operating state. The power source circuit 21 cuts electric power used in the IJ recording head driving circuit 23, the IJ recording head 24, the ROM 28, and the DRAM 29 that are in the-non-operating state. In other words, the power source circuit 21 may stop to supply the electric power to each element that is in the non-operating state. The power source circuit 21 controls the communication IF 27, the control unit 25, the OPU 26, and the navigation sensors 30 to be in the power-saving operating mode.

The communication IF 27 is in the power-saving operating mode. A communication driver IC or the like that the communication IF 27 includes is set to be in the energy-saving operating mode. For example, in a case of detecting reception of a print job, the communication IF 27 returns to be in the power-ON standby state. When the communication IF 27 is a USB I/F, the communication IF 27 returns to be in the power-ON standby state in a case where intersection/extraction is detected or a change of a USB host is detected. When the communication IF 27 is an Ethernet I/F, the communication IF 27 returns to be in the power-ON standby state in a case where communication requesting the return is obtained from the image data outputting device 11.

The ROM 28 and the DRAM 29 are in the non-operating state. In a case where the HMP 20 has received a print job before entering the energy-saving mode 1, the image data saving unit 57 stores the print job in the ROM 28 before changing to be in the energy-saving mode 1 because image data received by the communication IF 27 is stored in the DRAM 29. After that, the power source control unit 55 cuts the electric power used in the ROM 28 and the DRAM 29. In other words, the power source control unit 55 may stop to supply the power to the ROM 28 and the DRAM 29. In a case of returning, the image data saving unit 57 develops (loads) the image data from the ROM 28 on the DRAM 29 after the power source control unit 55 supplies the electric power to be used in the ROM 28 and the DRAM 29.

The navigation sensors 30 are in the power-saving operating state. In a state of being able to monitor a change of the position, the power source control unit 55 stops a part of the functions in order to monitor an operation by the user such as the positional change and lifting. As for the part of the functions to be stopped, for example, in a case of an optical navigation sensor, the sensor reduces a light quantity, and/or makes a frame rate (interval of detecting the change of the position) to be longer such that presence/absence of the movement can be detected because it is not necessary to detect the movement amount in detail.

The OPU 26 is in the power-saving operating state. In order to detect the user's operation, the OPU 26 stops other functions while being able to detect the user's operation. For example, in a case where the OPU 26 has a LED and a button, the OPU 26 turns off or blinks the LED without stopping the button detecting function. In a case where the OPU 26 has a button and a liquid crystal panel (LCD) such as a touch panel, the OPU 26 does not stop the button detecting function while turning off the entire LCD (does not have touch detection) or turning off only a backlight of the LCD (having touch detection).

Because the IJ recording head driving circuit 23 and the IJ recording head 24 are not used in the energy-saving mode, the power source control unit 55 cuts the electric power to the IJ recording head driving circuit 23 and the IJ recording head 24. Thus, the IJ recording head driving circuit 23 and the IJ recording head 24 are in the non-operating state.

The control unit 25 is in the power-saving operating state. At the time of changing to the energy-saving mode 1, the power source control unit sets each block to be in the non-operating state or the power-saving operating state. For example, during the energy-saving mode 1, an operating frequency of the CPU 31 becomes lower, and the control unit 25 monitors the OPU 26, the communication IF 27, and the navigation sensors 30 at longer time intervals than the intervals in the normal mode. An electric power consumption state of each block of the control unit 25 will be described next.

<<Electric Power Consumption State of the Control Unit>>

Figure 11:
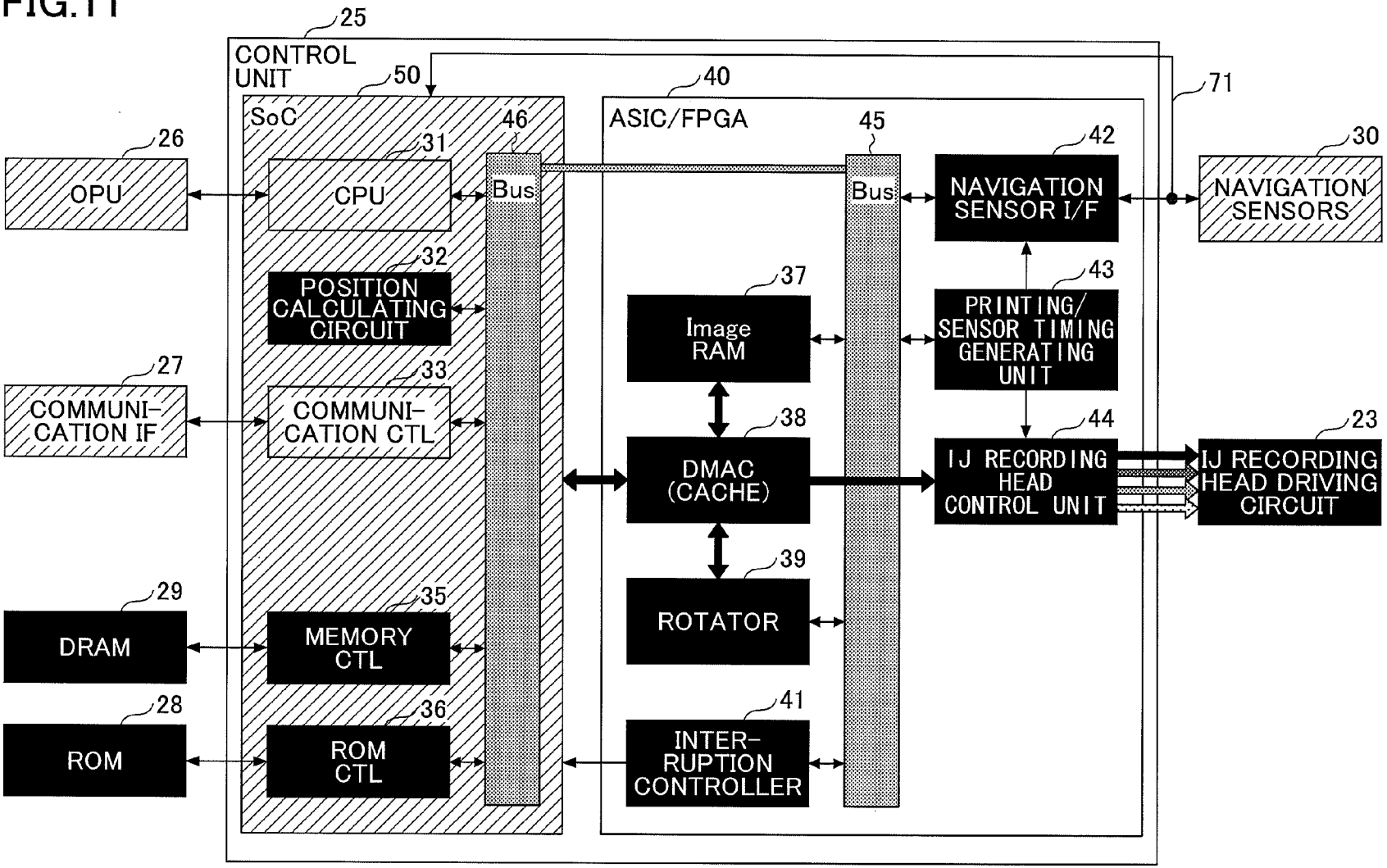
FIG. 11 is a block diagram illustrating an example of an electric power consumption state of the control unit in the energy-saving mode 1 according to the first embodiment.

FIG. 11 is a block diagram illustrating an example of an electric power consumption state of the control unit 25 in the energy-saving mode 1. The return factor from the energy-saving mode 1 is an operation of the OPU 26, reception of the print job by the communication IF 27, or detection of a movement (motion) by the navigation sensors 30. In this case, the SoC 50 and the navigation sensors 30 are coupled via a signal line 71 directly because the CPU 31 is required to control the navigation sensors 30.

Accordingly, the navigation sensors 30 can be controlled from either the SoC 50 or the ASIC/FPGA 40. In the normal mode, the ASIC/FPGA 40 monitors the navigation sensors 30, and the SoC 50 does not control the navigation sensors 30. In the energy-saving mode 1, for example, an operating frequency of the SoC 50 becomes lower, blocks (the CPU 31 and the communication CTL 33) that are used by the OPU 26 or the communication IF 27 are changed to be in the power-saving operating state. Accordingly, in the energy-saving mode 1, movements of the navigation sensors 30 are monitored by the CPU 31 from the SoC side having a lower operating frequency and the ASIC/FPGA 40 does not control the navigation sensors 30. Thereby, it is possible to change the whole ASIC/FPGA 40 to be in the non-operating state and to suppress the electric power consumption.

<<Another Example of Electric Power Consumption State of the Control Unit>>

Figure 12:
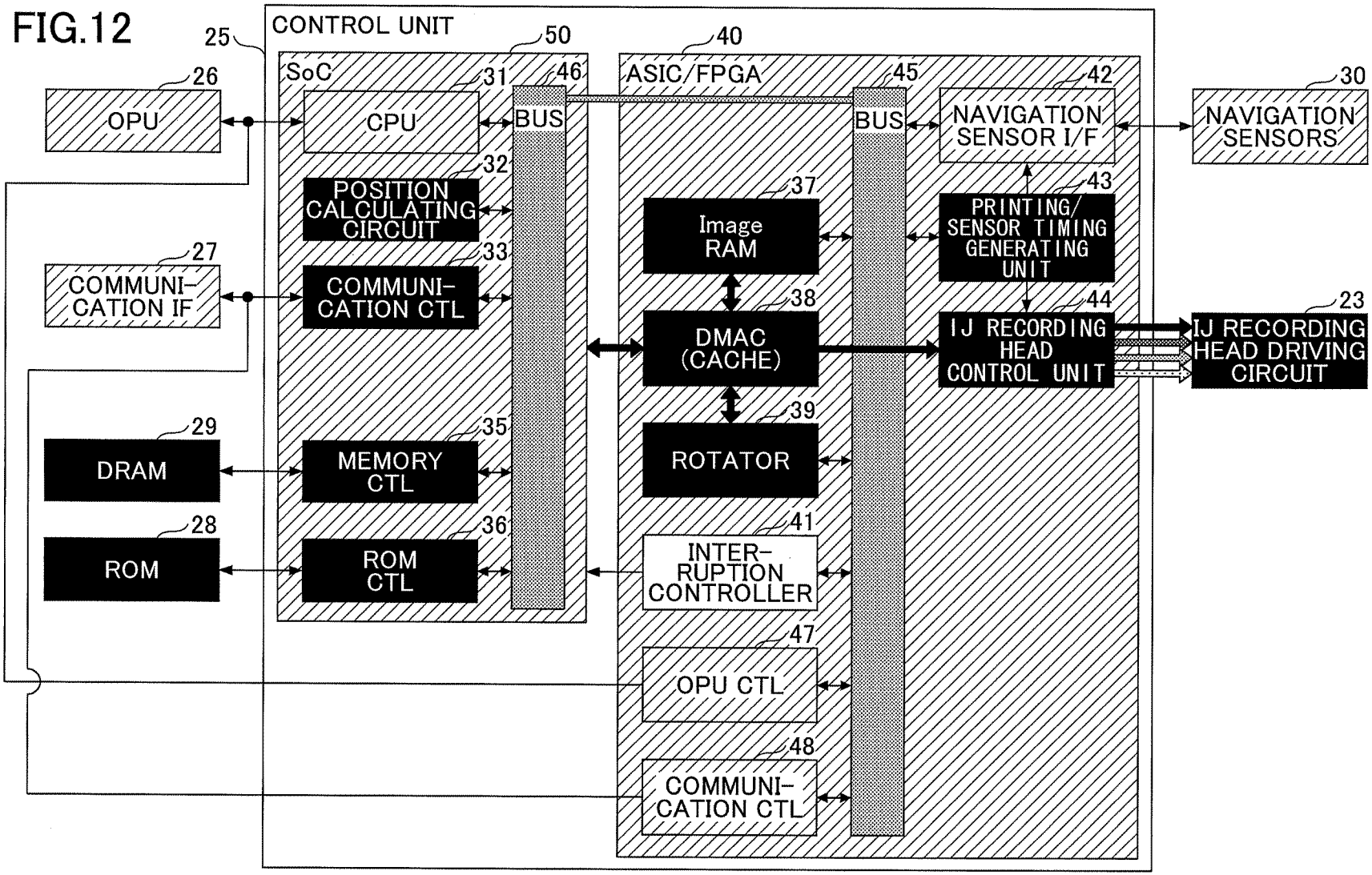
FIG. 12 is a block diagram illustrating another example of the electric power consumption state of the control unit in the energy-saving mode 1 according to the first embodiment.

In the energy-saving mode 1, the electric power consumption state of the control unit 25 may be controlled as follows. FIG. 12 is a block diagram illustrating another example of the electric power consumption state of the control unit 25 in the energy-saving mode 1 according to the first embodiment. FIG. 12 illustrates a configuration in which the ASIC/FPGA side detects the return factors, which are the operation of the OPU 26, the reception of the print job from the communication IF 27, and the detection of the movement by the navigation sensors 30.

The ASIC/FPGA 40 has an OPU CTL 47 and a communication CTL 48 in comparison with the configuration illustrated in FIG. 12. The OPU CTL 47 is coupled to the OPU 26. The communication CTL 48 is coupled to the communication IF 27. Accordingly, even the ASIC/FPGA 40 can control the functions of the OPU 26 and the communication IF 27. However, in the normal mode, the SoC 50 monitors the OPU 26, the communication IF 27, and the navigation sensors 30, and the ASIC/FPGA 40 does not control the OPU 26, the communication IF 27, and the navigation sensors 30.

In the energy-saving mode 1, only the CPU of the SoC 50 changes to be in the power-saving operating state, and other blocks of the SoC 50 change to be in the non-operating state. The operating frequency of the SoC 50 becomes lower, and only the interruption detecting function of the CPU operates. The navigation sensor I/F 42, the OPU CTL 47, and the communication CTL 48 of the ASIC/FPGA 40 change to be in the power-saving operating state. The interruption controller 41 is in the normal state.

The ASIC/FPGA 40 has charge of detecting function for the return factor by the OPU 26 and the communication IF 27. When the return factor is detected, the ASIC/FPGA 40 uses the interruption function to return the SoC 50 from the energy-saving mode 1. Further, because the ASIC/FPGA 40 can monitor the navigation sensors 30, the ASIC/FPGA 40 uses the interruption controller 41 to return the SoC 50 from the energy-saving mode 1 when detecting the movement.

According to such a configuration, it is unnecessary that the CPU 31 in the energy-saving mode 1 monitors the navigation sensors 30 as illustrated in FIG. 12, because the navigation sensor I/F 42 can monitor the navigation sensors 30. Further, it is possible to change blocks except for the CPU 31 of the SoC 50 to be in the non-operating state.

<Electric Power Supplying State in the Energy-Saving Mode 2>

Figure 13:
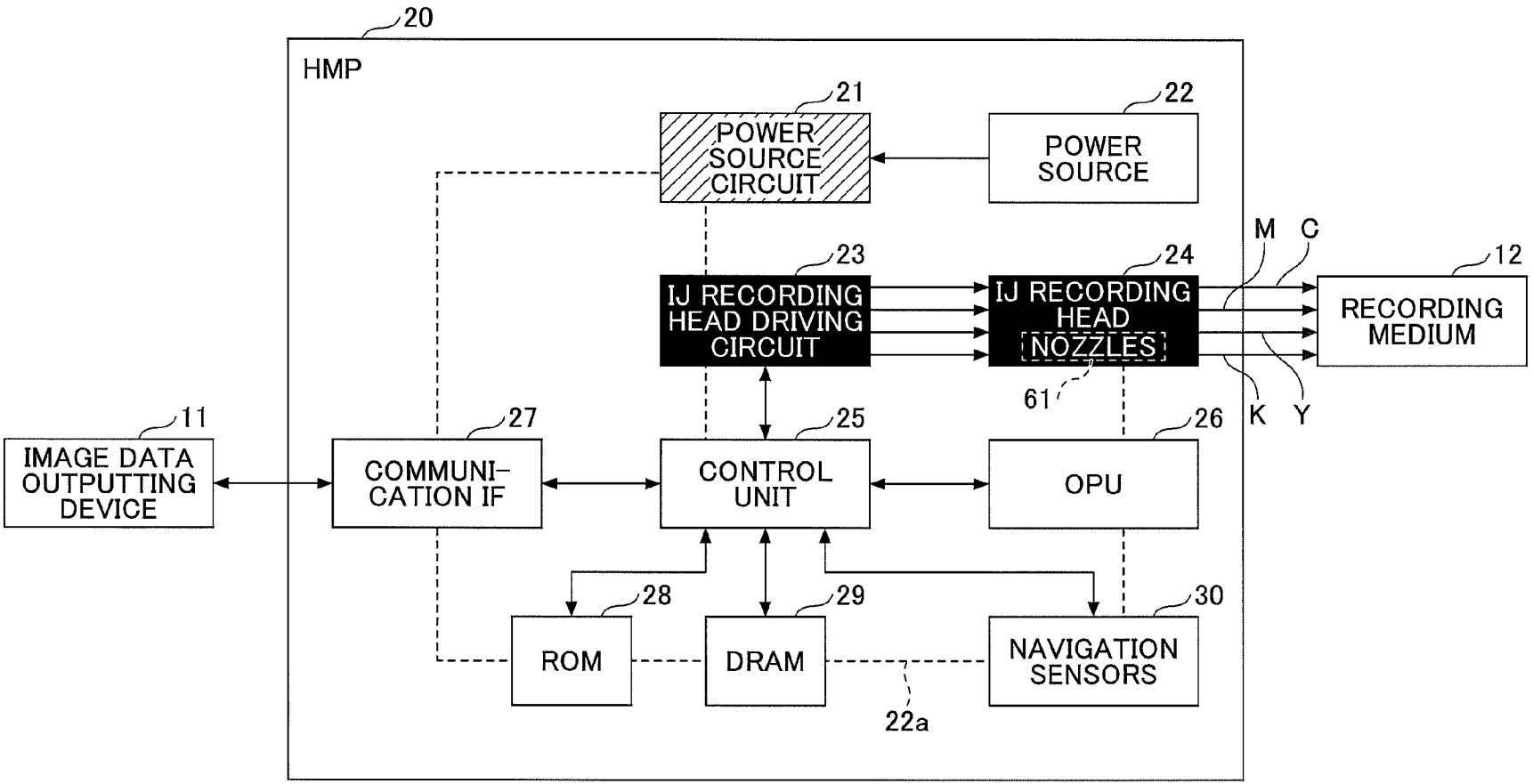
FIG. 13 is a block diagram illustrating an example of an electric power consumption state in the energy-saving mode 2 according to the first embodiment.

An electric power supplying state of the energy-saving mode 2 will be described with reference to FIG. 13 and the like. FIG. 13 is a block diagram illustrating an example of an electric power consumption state of the HMP 20 in the energy-saving mode 2. In the power-ON printing state, all blocks are in the operating state. When the HMP 20 changes to be in the energy-saving mode 2 from the power-ON printing state, the IJ recording head driving circuit 23 and the IJ recording head 24 change to be in the non-operating state. The power source circuit 21 is in the power-saving operating state. Accordingly, it is possible to reduce the power consumption in the energy-saving mode 2 to a power consumption equivalent to the power consumption in the power-ON standby state. In other words, the electric power consumption of the energy-saving mode 2 is less than the electric power consumption of the power-ON printing state of ejecting ink on the recording medium 12 because the electric power is not supplied to the IJ recording head driving circuit 23 and the IJ recording head 24 in the energy-saving mode 2. It should be noted that the power source circuit 21 may continue to supply the electric power to at least one function (part) that the position calculating circuit 32 and the navigation sensors 30 use to calculate the position of the HMP 20 when the state of the HMP 20 changes to the energy-saving mode 2 from the power-ON printing state.

Thus, in the energy-saving mode 2, the HMP 20 does not lose the position when returning because the navigation sensors 30 are in the normal state.

<<Procedure of Changing/Returning to/from the Energy-Saving Mode 2>>

Figure 14:
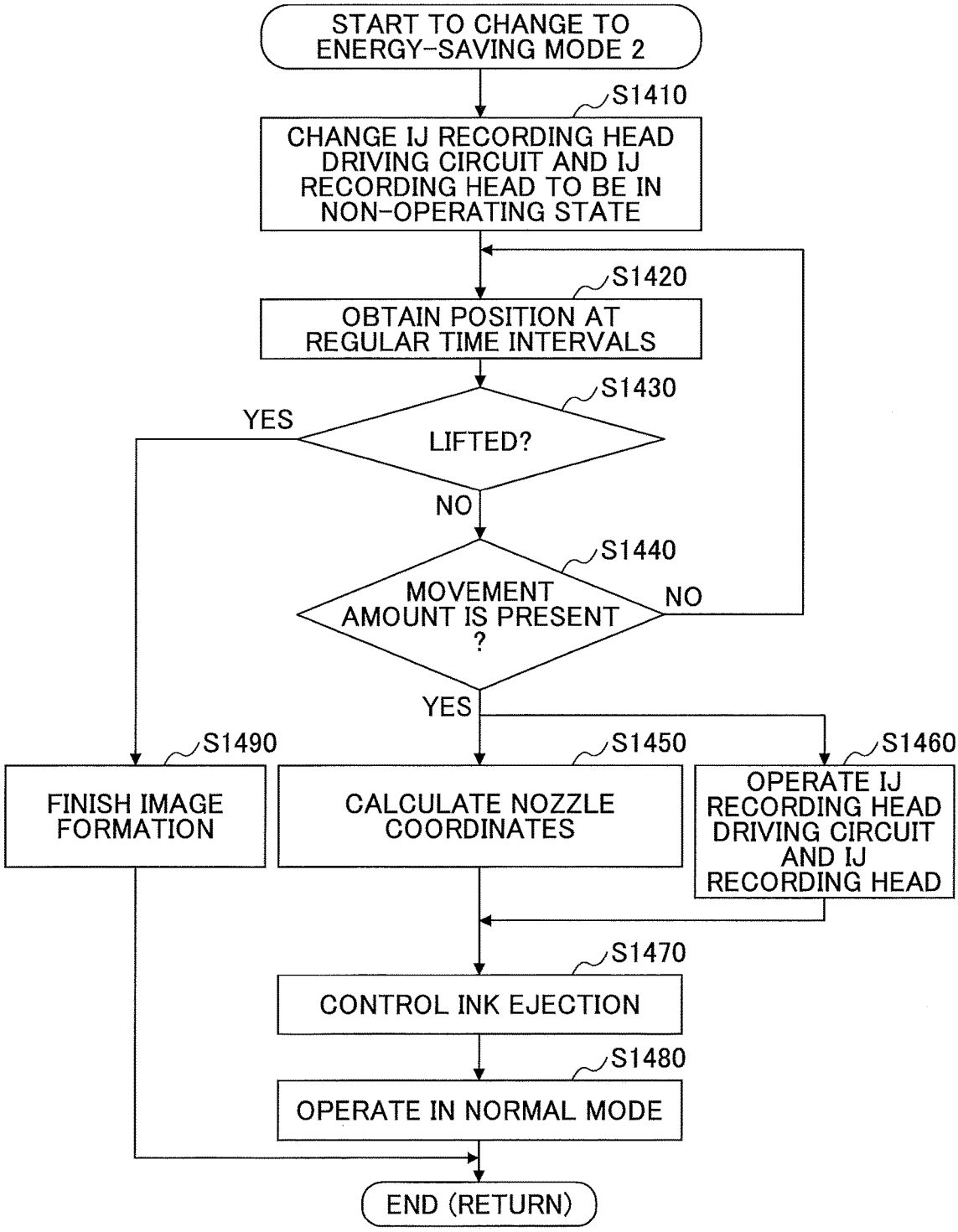
FIG. 14 is a flowchart illustrating an example of a detailed procedure of changing to the energy-saving mode 2 and a detailed procedure of returning from the energy-saving mode 2 in the power-ON printing state according to the first embodiment.

FIG. 14 is a flowchart illustrating an example of a detailed procedure of changing to the energy-saving mode 2 and a detailed procedure of returning from the energy-saving mode 2 in the power-ON printing state according to the first embodiment. The procedure of FIG. 14 starts when it is determined that the change condition for changing to the energy-saving mode 2 is satisfied.

Initially, the power source control unit 55 changes the IJ recording head driving circuit 23 and the IJ recording head 24 to be in the non-operating state in step S1410. As illustrated in FIG. 13, the position calculating circuit 32 and the navigation sensors 30 remain in the normal state.

Next, the return factor determining unit 53 obtains a position, detected by the position calculating circuit 32, at regular time intervals in step S1420. The regular time intervals may be similar to the regular time intervals of step S50 illustrated in FIG. 7. The position is obtained at the regular time intervals to be able to detect the movement.

Next, the lift determining unit 56 determines in step S1430 whether the HMP 20 is lifted.

In a case where the lift determining unit 56 determines that the HMP 20 is lifted (YES in step S1430), the image forming unit 58 finishes the image formation in step S1490.

In a case where the lift determining unit 56 determines that the HMP 20 is not lifted (NO in step S1430), the return factor determining unit 53 determines whether a movement is detected in step S1440. Because the navigation sensors 30 are in the normal state, the return factor determining unit 53 can detect the positional change. In a case where the return factor determining unit 53 determines that the movement is not detected (NO in step S1440), the processing of step S1420 is repeated to obtain the position until the movement is detected.

In a case where the movement is detected (YES in step S1440), the position calculating circuit applies the movement amount, detected by the navigation sensors 30, to the position, which has been calculated in the energy-saving mode 2 by the position calculating circuit 32, to calculate a position (coordinates) of the nozzles in step S1450. That is, movement amounts ($\Delta X'$ and $\Delta Y'$) are applied to the position (X, Y) calculated in the energy-saving mode 2 as described in the above formulas (1) and (2) to find the current position of the nozzles.

Further, the power source control unit 55 restarts to supply the electric power to the IJ recording head driving circuit 23 and the IJ recording head 24 in step S1460. In the energy-saving mode 2, it is possible to calculate the position similarly to the normal mode because both the control unit 25 and the navigation sensors 30 are in the normal state.

The image forming unit 58 ejects ink to form the image in step S1470 when the coordinates of the nozzles are within a predetermined distance from the target ejection position. After that, the calculation of the position and the image formation are repeatedly performed (step S1480).

As described above, in the energy-saving mode 2 according to the first embodiment, because only the IJ recording head driving circuit 23 and the IJ recording head 24 are changed to be in the non-operating state, the electric power consumption can be reduced more than the electric power consumption in the power-ON printing state. Further, because the control unit 25, the ROM 28, the DRAM 29, and the navigation sensors 30 remain in the normal state in the energy-saving mode 2, it is possible to restart the image formation at the time of returning from the energy-saving mode 2 without losing the position.

Second Embodiment

The HMP 20 according to a second embodiment that can further reduce the electric power consumption in the energy-saving mode 2 will be described.

Figure 15:
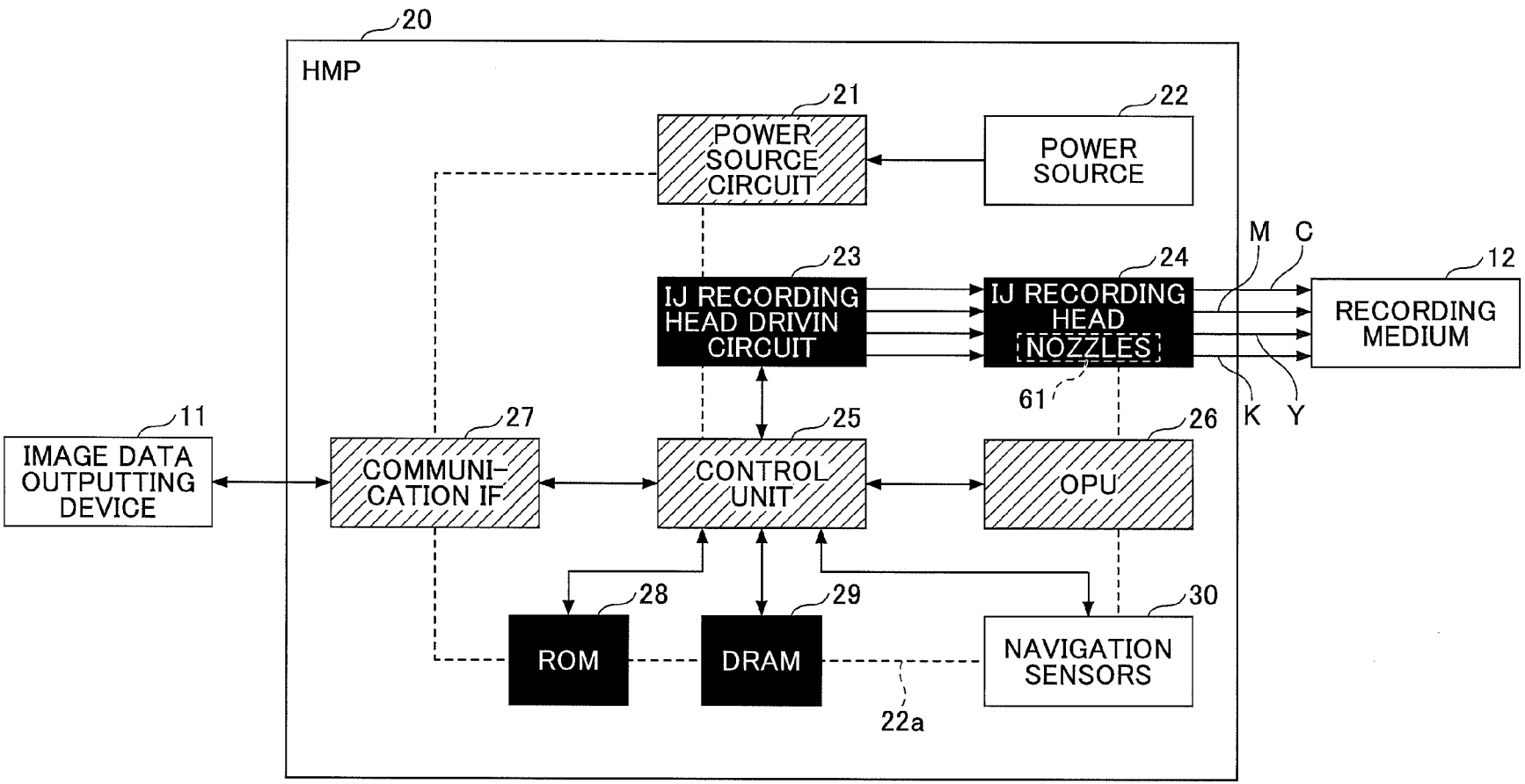
FIG. 15 is a block diagram illustrating an example of an electric power consumption state of the energy-saving mode 2 according to a second embodiment.

FIG. 15 is a block diagram illustrating an example of an electric power consumption state of the energy-saving mode 2 according to the second embodiment. In FIG. 15, the power source 22 and the navigation sensors 30 are in the normal state, the OPU 26, the communication IF 27, the control unit 25, and the power source circuit 21 are in the power-saving operating state, and the DRAM 29, the ROM 28, the IJ recording head driving circuit 23, and the IJ recording head 24 are in the non-operating state.

According to the second embodiment, in the energy-saving mode 2, it becomes possible to further reduce the power consumption than that of the first embodiment because the number of blocks in the power-saving operating state is greater than that of FIG. 13. Also, it becomes possible to further reduce the power consumption than the power-ON standby state. It should be noted, in the energy-saving mode 2, the power source circuit 21 may supply the electric power only to the function (at least one part) that the position calculating circuit 32 and the navigation sensors 30 use to calculate the position of the HMP and stop to supply the electric power to other functions (parts) of the HMP 20.

Figure 16:
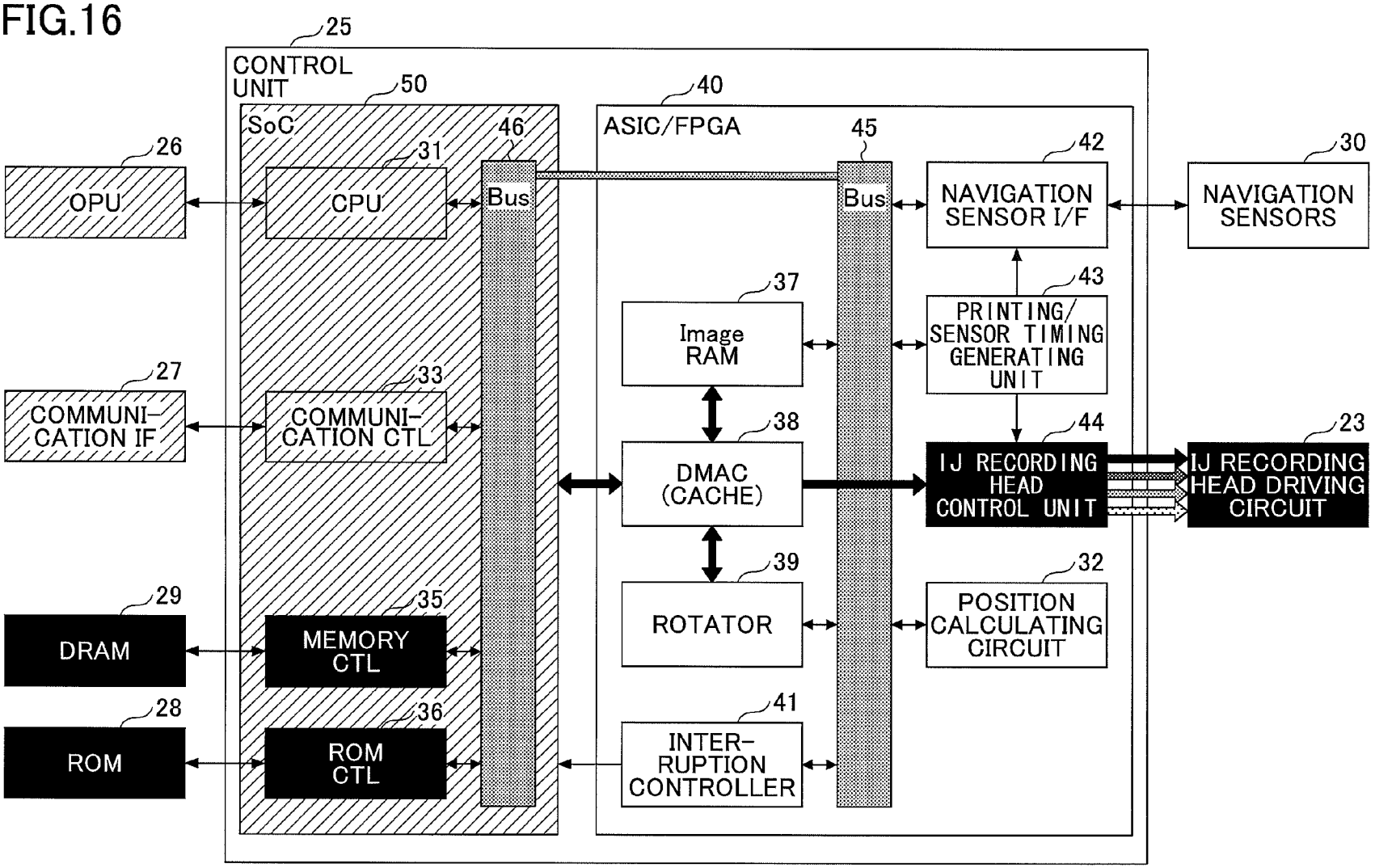
FIG. 16 is a block diagram illustrating an example of an electric power consumption state of the control unit in the energy-saving mode 2 according to the second embodiment.

FIG. 16 is a block diagram illustrating an example of an electric power consumption state of the control unit 25 in the energy-saving mode 2 according to the second embodiment. As illustrated in FIG. 16, the CPU 31 and the communication CTL 33 are in the power-saving operating state, and the memory CTL 35 and the ROM CTL 36 are in the non-operating state. In the blocks of the ASIC/FPGA 40, only the IJ recording head control unit 44 is in the non-operating state, and other blocks are in the normal state. The ASIC/FPGA 40 includes the position calculating circuit 32. In other words, in the energy-saving mode 2, the power source circuit 21 may supply the electric power to the function (part) of the communication CTL 33, which receives the image data, and the function (part) of the CPU 31, which receives via the OPU 26 an operation on the HMP 20, to operate the functions (parts) of the communication CTL 33 and the CPU 31. However, the electric power that the power source circuit 21 supplies to the functions (parts) of the communication CTL 33 and the CPU 31 in the energy-saving mode 2 may be less than the electric power that the power source circuit 21 supplies to the functions (parts) of the communication CTL 33 and the CPU 31 in the power-ON printing state.

In such an electric power consumption state, the SoC 50 detects the return factors, which are the operation of the OPU 26, and the reception of the print job from the communication IF 27. The ASIC/FPGA side detects the movement by the navigation sensors 30. The SoC 50 detects an interruption from the ASIC/FPGA side based on the detection of the movement by the navigation sensors 30. Further, because the FPGA/ASIC includes the position calculating circuit 32, a frequency of updating the position depends on an operating frequency of the ASIC/FPGA 40. Thereby, it is possible to decrease an operating frequency of the SoC 50.

In the normal state, the SoC 50 monitors the OPU 26, the communication IF 27, and the navigation sensors 30, and the ASIC/FPGA 40 does not control the OPU 26, the communication IF 27, and the navigation sensors 30.

In this way, when the number of blocks in the power-saving operating state or the non-operating state is increased, it is easy to reduce the electric power consumption but a time required for returning completely may be longer. Thus, the Image RAM 37 is used to deal with the movement of the HMP 20 in a time until the return is completed.

<<Procedure of Changing/Returning to/from the Energy-Saving Mode 2>>

Figure 17:
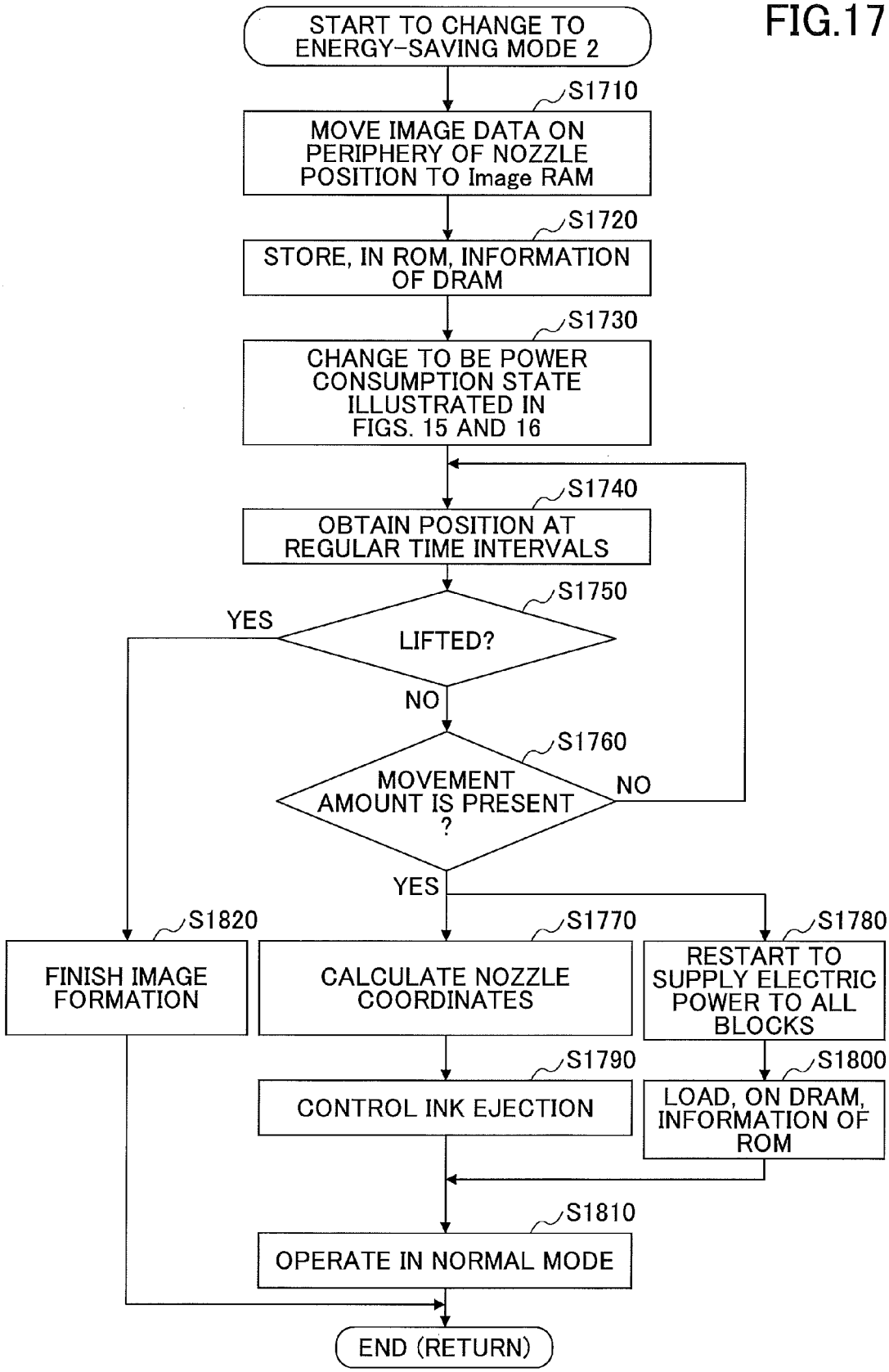
FIG. 17 is a flowchart illustrating an example of a detailed procedure of changing to the energy-saving mode 2 and a detailed procedure of returning from the energy-saving mode 2 in the power-ON printing state according to the second embodiment.

FIG. 17 is a flowchart illustrating an example of a detailed procedure of changing to the energy-saving mode 2 and a detailed procedure of returning from the energy-saving mode 2 in the power-ON printing state according to the second embodiment. The procedure of FIG. 17 starts when it is determined that the change condition for changing to the energy-saving mode 2 is satisfied.

Before changing to the energy-saving mode 2, the image forming unit 58 moves the image data on the periphery of the current nozzle position to the Image RAM 37 of the ASIC/FPGA 40 from the DRAM 29 in step S1710. Thus, it becomes possible to form the image even when the user moves the HMP 20 quickly at the time of returning from the energy-saving mode 2. In other words, when the state of the HMP 20 changes to the energy-saving mode 2 from the power-ON printing state, at least part of the image data, relating to the image to be formed on the recording medium 12, is moved to the Image RAM 37 from the DRAM 29. Then, when the state of the HMP 20 returns from the energy-saving mode 2 to the power-ON printing state, the image forming unit 58 can read out the data from the Image RAM 37 to eject ink based on the readout data.

At this time, the image forming unit 58 determines an amount of the image data to be stored in the Image RAM 37 from a time required for returning to the normal mode from the state of the energy-saving mode 2 of FIG. 16 and a maximum scanning speed that the HMP 20 ensures (has). For example, it is assumed that the maximum scanning speed that the HMP 20 ensures is 100 mm/s and the time required for completely returning to the normal mode from the state of the energy-saving mode 2 is 50 ms. Based on the formula of 50 ms×100 mm/s, the maximum movement distance until the return is completed is 5 mm. Accordingly, image data of 5 mm around the nozzle lines is stored. In other words, the image forming unit 58 may determine, based on at least a predetermined speed of the HMP 20 and the time required for completely returning to the power-ON printing state from the energy-saving mode 2, a size of the image data to be moved to the Image RAM 37 from the DRAM 29.

Further, a time (such as a communication speed between the SoC 50 and the ASIC/FPGA 40) until updating the Image RAM 37 after the return may be considered. In this case, the time until updating the Image RAM 37 may be added to the time 50 ms, which is required for completely returning to the normal mode from the state of the energy-saving mode 2, to calculate the maximum movement distance. In other words, the image forming unit 58 may determine the size of the image data to be moved to the Image RAM 37 from the DRAM 29 based on a time obtained by adding a time, for moving the image data to the Image RAM 37 from the DRAM 29, to the time required for completely returning to the power-ON printing state from the energy-saving mode 2.

Next, the image data saving unit 57 saves, to the ROM 28 in step S1720, information, relating to the print job in the DRAM 29. This is because the DRAM 29 enters the non-operating state. The information relating to the print job is image data printed to halfway, for example.

Then, the power source control unit 55 controls the power consumption state of each block of the HMP 20 as illustrated in FIGS. 15 and 16 in step S1730. It should be noted that in the energy-saving mode 2 of FIGS. 15 and 16, the power source control unit 55 stops to supply the electric power to the DRAM 29 but supplies the electric power to the Image RAM 37.

Next, the return factor determining unit 53 obtains a position, detected by the position calculating circuit 32, at regular time intervals in step S1740. The regular time intervals may be similar to the regular time intervals of step S50 illustrated in FIG. 7. The position is obtained at the regular time intervals to be able to detect the movement.

Next, the lift determining unit 56 determines in step S1750 whether the HMP 20 is lifted.

In a case where the lift determining unit 56 determines that the HMP 20 is lifted (YES in step S1750), the image forming unit 58 finishes the image formation in step S1820.

In a case where the lift determining unit determines that the HMP 20 is not lifted (NO in step S1750), the return factor determining unit 53 determines whether a movement is detected in step S1760. Because the navigation sensors 30 are in the normal state, the return factor determining unit 53 can detect the movement amount. In a case where the return factor determining unit 53 determines that the movement is not detected (NO in step S1760), the processing of step S1740 is repeated to obtain the position until the movement is detected.

In a case where the movement is detected (YES in step S1760), the position calculating circuit calculates coordinates of the nozzles in step S1770 and the power source control unit 55 restarts to supply the electric power to all blocks in step S1780. That is, the power source control unit 55 returns the all blocks to be in the normal state. Because the position calculating circuit 32 and the navigation sensors 30 remain in the normal state, the position calculating circuit 32 and the navigation sensors 30 can calculate the position similarly to the normal mode.

When the position of the nozzles is within a predetermined distance from the target ejection position, the image forming unit 58 ejects ink to form the image based on the image data of the Image RAM 37 in step S1790. Using the image data saved in the Image RAM 37, it is possible to form the image even when the HMP 20 is moved before the SoC 50 returns.

Further, the image forming unit 58 develops (loads), on the DRAM 29 in step S1800, the information relating to the print job saved in the ROM 28.

After that, calculation of the position and the image formation are repeatedly performed (step S1810).

According to the second embodiment, because the image data can be saved to the Image RAM 37, even when the HMP 20 is moved before the SoC 50 returns completely, the image formation can be continued. Further, because the control unit 25 of the SoC 50 is made to be in the power-saving operating state or the non-operating state, it becomes possible to reduce the electric power consumption.

Variation Example

The HMP 20 may have two or more types of states for the energy-saving mode 2. As the energy-saving mode 2 of the first embodiment, the energy-saving mode 2*a* is set such that a time for returning from the energy-saving mode 2*a* is short. As the energy-saving mode 2 of the second embodiment, the energy-saving mode 2*b* is set such that a time for returning from the energy-saving mode 2*b* is long. The electric power consumption of the energy-saving mode 2*b* is less than the electric power consumption of the energy-saving mode 2*a*.

Figure 18:
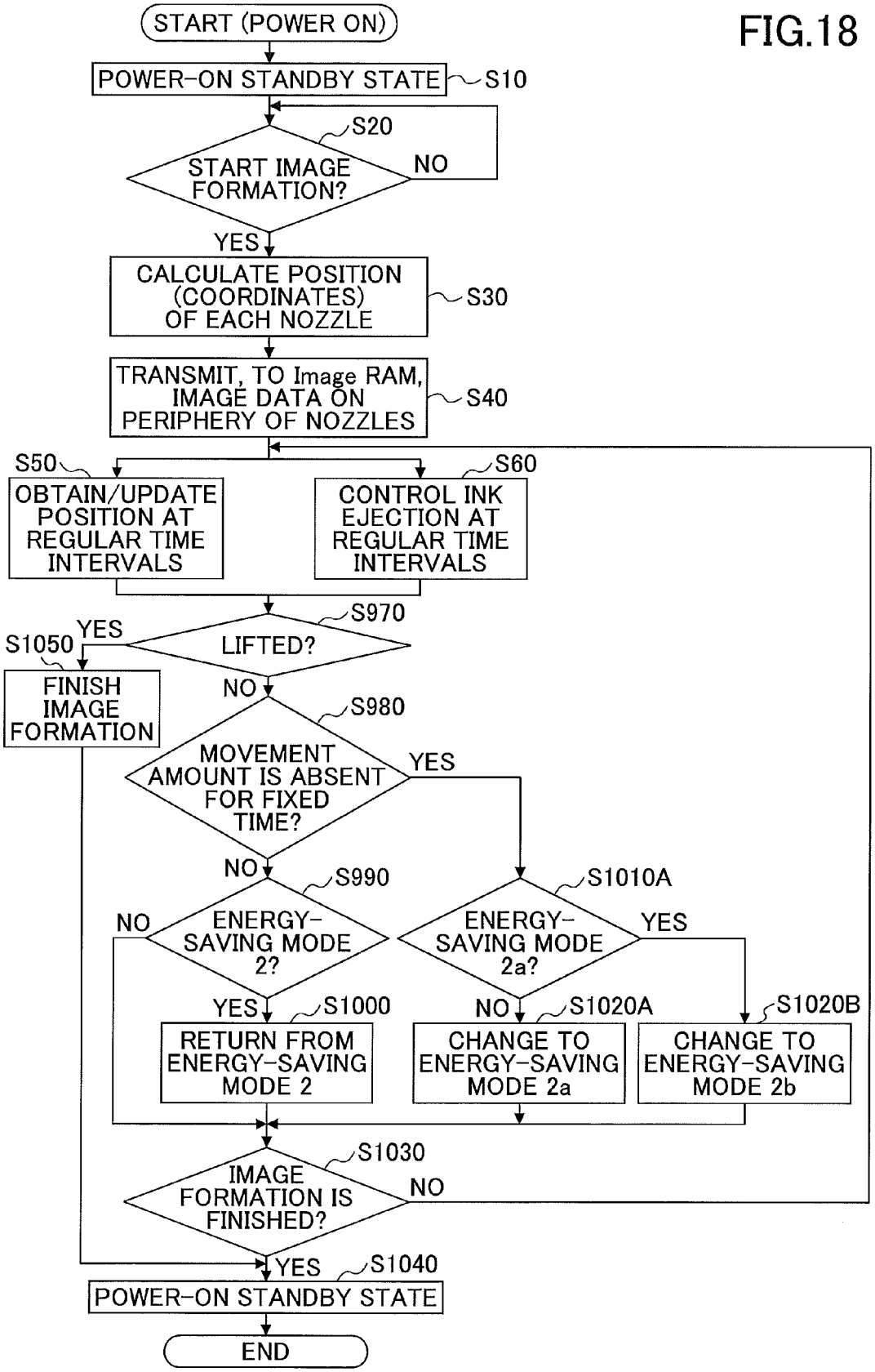
FIG. 18 is a flowchart illustrating a variation example of a procedure of changing to the energy-saving mode 2 in the power-ON printing state.

Procedures of a variation example changing to the energy-saving mode 2 in the power-ON printing state will be described with reference to FIG. 18. FIG. 18 is a flowchart illustrating an example of the procedure of changing to the energy-saving mode 2 in the power-ON printing state according to a variation example. In descriptions of FIG. 18, differences with the descriptions of FIG. 9 will be mainly described.

In step S1010A, the power source mode control unit 54 determines whether a current operating mode is the energy-saving mode 2*a*. In a case of determining that the current operating mode is the energy-saving mode 2*a* (YES in step S1010A), the power source mode control unit 54 determines to change the mode to the energy-saving mode 2*b* that can further suppress the power consumption in step S1020B because the fixed time has passed in the state of the energy-saving mode 2*a*. In other words, the energy-saving change determining unit 52 may determine to change the state of the HMP 20 to the energy-saving mode 2*b* from the energy-saving mode 2*a* in a case where the position calculated by the position calculating circuit 32 does not change for a time longer than a predetermined time and the position is regarded as constant.

As described in the first and second embodiments, because the electric power consumption state of the energy-saving mode 2*a* is different from the electric power consumption state of the energy-saving mode 2*b*, the image forming unit 58 stores, in the ROM 28, information relating to the print job when changing to the energy-saving mode 2*b* such that the print job during the image formation can be processed again.

In a case where the mode has not been changed to the energy-saving mode 2*a* (NO in step S1010A), the power source mode control unit 54 determines to change the mode to the energy-saving mode 2*a* in step S1020A.

Here, the fixed time in step S980 for changing to the energy-saving mode 2*a* from the power-ON printing state does not have to be equal to the fixed time in step S980 for changing to the energy-saving mode 2*b* from the energy-saving mode 2*a*. Further, the user may set the fixed time.

According to the transition of the energy-saving modes 2*a* and 2*b*, it is possible to guess that the HMP 20 changed to the energy-saving mode 2*b* has been left for a long time. After changing to the energy-saving mode 2*b*, the image forming unit 58 may finish the image formation because it takes a time for returning. That is, the HMP 20 changes to be in the power-ON standby state. In this case, because the position is not lost but it is estimated that the user does not form the image, the image forming unit 58 deletes the image data from the ROM 28. Thus, a leak of the image data can be prevented. After returning from the energy-saving mode 2*b*, a next printing job is executed.

Other Examples of Application

Although, the embodiments for carrying out the present disclosure are described above, the present disclosure is not limited to these embodiments, but various variations and modifications may be made without departing from the scope of the present invention.

For example, in the block diagrams FIGS. 1 and 2 illustrating the hardware configuration, the elements of the HMP 20 are divided in accordance with main functions in order to facilitate understanding of the processing by the HMP 20. The present disclosure is not limited by the way of dividing the processing units and by the names of the elements.

In the block diagram FIG. 3 illustrating the functional configuration, the elements of the HMP are divided in accordance with main functions in order to facilitate understanding of the processing by the HMP 20. The present disclosure is not limited by the way of dividing the processing units and by the names of the elements. The processing (elements) of the HMP 20 can be divided into a greater number of processing units depending on processing contents. Further, the processing (elements) can be divided such that one processing unit includes greater number of processing.

Further, the above described configuration elements of the SoC 50 and the ASIC/FPGA 40 may be included in either the SoC 50 or the ASIC/FPGA 40 depending on CPU performance and a circuit size of the ASIC/FPGA 40.

Although ink is ejected as ejection materials to form the image in the above described embodiments, metal paste may be ejected as the ejection materials to form the image. Further, visible light, ultraviolet light, infrared light, a laser, and/or the like may be emitted as the ejection materials to form the image. In this case, a material that reacts to light, heat, and/or the like may be used as the recording medium 12, for example. Further, transparent liquid may be ejected. In this case, visible information is obtained when light having a specific wavelength band is emitted.

The navigation sensors 30 are an example of a movement amount detecting unit. The position calculating circuit 32 is an example of a position calculating unit. The power source mode control unit 54, the power source control unit 55, and the power source circuit 21 are an example of an electric power supplying unit. The return factor determining unit is an example of a return factor detecting unit. The power-ON printing state is an example of a first operating mode. The energy-saving mode 2 is an example of a second operating mode. The DRAM 29 is an example of a first storage unit. The ROM 28 or the Image RAM 37 is an example of a second storage unit. The image forming unit 58 is an example of an ejection control unit. The function (part) of the communication CTL 33 that receives the image data is an example of a first function (first part). The function (part) of the CPU 31 that receives the operation via the OPU 26 is an example of a second function (second part). The energy-saving change determining unit 52 is an example of an operating mode changing unit. The energy-saving mode 2*b* is an example of a third operating mode. The method for ejecting ink performed by the HMP 20 described in the embodiments is an example of a liquid ejecting method.

It should be noted that the above described apparatus according to the embodiments may be realized by a device memory, which stores at least one program, and at least one processor, which executes the at least one program to execute processing as described in the embodiments. In other words, the HMP 20 may be realized by the device memory and the at least one processor, for example. For example, the device memory and the at least one processor can implement functions as described in the embodiments and may be implemented by hardware elements as described in the embodiments.

The order of the method of the present disclosure is not limited to the order of processes of the method disclosed in the above described embodiments.

The present disclosure can be implemented in any convenient form, for example using dedicated hardware, or a mixture of dedicated hardware and software. The present disclosure may be implemented as computer software implemented by one or more networked processing apparatuses. The network can comprise any conventional terrestrial or wireless communications network, such as the Internet. The processing apparatuses can compromise any suitably programmed apparatuses such as a general purpose computer, personal digital assistant, mobile telephone (such as a WAP or 3G-compliant phone) and so on. Because the present disclosure can be implemented as software, each and every aspect of the present disclosure thus encompasses computer software implementable on a programmable device. The computer software can be provided to the programmable device using any storage medium for storing processor readable code such as a floppy disk, hard disk, CD ROM, magnetic tape device or solid state memory device.

The hardware platform includes any desired kind of hardware resources including, for example, a central processing unit (CPU), a random access memory (RAM), and a hard disk drive (HDD). The CPU may be implemented by any desired kind of any desired number of processor. For example, the CPU may be implemented by one or more processors. The RAM may be implemented by any desired kind of volatile or non-volatile memory. The HDD may be implemented by any desired kind of non-volatile memory capable of storing a large amount of data. The hardware resources may additionally include an input device, an output device, or a network device, depending on the type of the apparatus. Alternatively, the HDD may be provided outside of the apparatus as long as the HDD is accessible. In this example, the CPU, such as a cache memory of the CPU, and the RAM may function as a physical memory or a primary memory of the apparatus, while the HDD may function as a secondary memory of the apparatus.

Here, at least one program may be stored in a non-transitory recording medium that causes the HMP 20 to execute processing as described in the embodiments.

What is claimed is:

1. A liquid ejecting apparatus for ejecting materials on a recording medium in accordance with a position of the liquid ejecting apparatus on the recording medium and an image that is to be formed on the recording medium, the liquid ejecting apparatus being movable on the recording medium by an external force, the liquid ejecting apparatus comprising;

a position calculating unit configured to calculate the position of the liquid ejecting apparatus on the recording medium;

an electric power supplying unit configured to supply electric power to a part that the position calculating unit uses to calculate the position when a state of the liquid ejecting apparatus changes to a second operating mode whose electric power consumption is less than an electric power consumption of a first operating mode of ejecting the materials on the recording medium; and a return factor detecting unit configured to detect a return factor for returning the state of the liquid ejecting apparatus to the first operating mode from the second operating mode, wherein, when the state of the liquid ejecting apparatus returns to the first operating mode from the second operating mode, the liquid ejecting apparatus restarts to eject the materials from the position that has been calculated by the position calculating unit in the second operating mode.

2. The liquid ejecting apparatus according to claim 1, further comprising:

an ejection control unit, wherein, in the second operating mode, the power supplying unit stops to supply the electric power to a first storage unit in which image data relating to the image is stored, wherein, when the state of the liquid ejecting apparatus changes to the second operating mode from the first operating mode, at least part of the image data is moved to a second storage unit, to which the electric power is supplied even in the second operating mode, and wherein, when the state of the liquid ejecting apparatus returns to the first operating mode from the second operating mode, the ejection control unit reads out, from the second storage unit, the image data, which is in accordance with the position that the position calculating unit calculates, to eject, on the recording medium, the materials based on the image data.

3. The liquid ejecting apparatus according to claim 2, wherein the ejection control unit determines, based on at least a predetermined moving speed of the liquid ejecting apparatus and a time required for completely returning to the first operating mode from the second operating mode, a size of the image data to be moved to the second storage unit from the first storage unit.

4. The liquid ejecting apparatus according to claim 3, wherein the ejection control unit determines the size of the image data based on a time obtained by adding a time, for moving the image data to the second storage unit from the first storage unit, to the time, required for completely returning to the first operating mode from the second operating mode.

5. The liquid ejecting apparatus according to claim 4, wherein the electric power that the power supplying unit supplies to the part, which the position calculating unit uses to calculate the position, in the second operating mode is equivalent to the electric power that the power supplying unit supplies to the part, which the position calculating unit uses to calculate the position, in the first operating mode, wherein, in the second operating mode, the power supplying unit supplies the electric power to a first part, which receives the image data relating to the image, and a second part, which receives an operation to the liquid ejecting apparatus, to make the first part and the second part be in an operating state, and wherein the electric power that the power supplying unit supplies to the first part and the second part in the second operating mode is less than the electric power that the power supplying unit supplies to the first part and the second part in the first operating mode.

6. The liquid ejecting apparatus according to claim 2, wherein the electric power that the power supplying unit supplies to the part, which the position calculating unit uses to calculate the position, in the second operating mode is equivalent to the electric power that the power supplying unit supplies to the part, which the position calculating unit uses to calculate the position, in the first operating mode, wherein, in the second operating mode, the power supplying unit supplies the electric power to a first part, which receives the image data relating to the image, and a second part, which receives an operation to the liquid ejecting apparatus, to make the first part and the second part be in an operating state, and wherein the electric power that the power supplying unit supplies to the first part and the second part in the second operating mode is less than the electric power that the power supplying unit supplies to the first part and the second part in the first operating mode.

7. The liquid ejecting apparatus according to claim 3, wherein the electric power that the power supplying unit supplies to the part, which the position calculating unit uses to calculate the position, in the second operating mode is equivalent to the electric power that the power supplying unit supplies to the part, which the position calculating unit uses to calculate the position, in the first operating mode, wherein, in the second operating mode, the power supplying unit supplies the electric power to a first part, which receives the image data relating to the image, and a second part, which receives an operation to the liquid ejecting apparatus, to make the first part and the second part be in an operating state, and wherein the electric power that the power supplying unit supplies to the first part and the second part in the second operating mode is less than the electric power that the power supplying unit supplies to the first part and the second part in the first operating mode.

8. The liquid ejecting apparatus according to claim 2, further comprising:

an operating mode changing unit configured to change the state of the liquid ejecting apparatus to the first operating mode from the second operating mode in a case where the position calculated by the position calculating unit does not change for a time longer than a predetermined time and the position is regarded as constant, wherein the return factor detecting unit detects the return factor in a case where a movement of the liquid ejecting apparatus is detected by the position calculated by the position calculating unit in the second operating mode.

9. The liquid ejecting apparatus according to claim 8, wherein, in the second operating mode, the power supplying unit supplies the electric power only to the part, which the position calculating unit uses to calculate the position, and cuts the electric power to the other parts of the liquid ejecting apparatus, wherein the operating mode changing unit changes the state of the liquid ejecting apparatus to a third operating mode from the second operating mode in a case where the position calculated by the position calculating unit does not change for the time longer than the predetermined time and the position is regarded as constant, an electric power consumption of the third operating mode being less than the electric power consumption of the second operating mode, wherein the electric power that the power supplying unit supplies to the part, which the position calculating unit uses to calculate the position, in the third operating mode is equivalent to the electric power that the power supplying unit supplies to the part, which the position calculating unit uses to calculate the position, in the first operating mode, wherein, in the third operating mode, the power supplying unit supplies the electric power to a first part, which receives image data relating to the image, and a second part, which receives an operation to the liquid ejecting apparatus, to make the first part and the second part be in an operating state, and wherein the electric power that the power supplying unit supplies to the first part and the second part in the third operating mode is less than the electric power that the power supplying unit supplies to the first part and the second part in the first operating mode.

10. The liquid ejecting apparatus according to claim 1, wherein, in the second operating mode, the power supplying unit supplies the electric power only to the part that the position calculating unit uses to calculate the position and cuts the electric power to other parts of the liquid ejecting apparatus.

11. The liquid ejecting apparatus according to claim 10, further comprising:

an operating mode changing unit configured to change the state of the liquid ejecting apparatus to the first operating mode from the second operating mode in a case where the position calculated by the position calculating unit does not change for a time longer than a predetermined time and the position is regarded as constant, wherein the return factor detecting unit detects the return factor in a case where a movement of the liquid ejecting apparatus is detected by the position calculated by the position calculating unit in the second operating mode.

12. The liquid ejecting apparatus according to claim 11, wherein, in the second operating mode, the power supplying unit supplies the electric power only to the part, which the position calculating unit uses to calculate the position, and cuts the electric power to other parts of the liquid ejecting apparatus, wherein the operating mode changing unit changes the state of the liquid ejecting apparatus to a third operating mode from the second operating mode in a case where the position calculated by the position calculating unit does not change for the time longer than the predetermined time and the position is regarded as constant, an electric power consumption of the third operating mode being less than the electric power consumption of the second operating mode, wherein the electric power that the power supplying unit supplies to the part, which the position calculating unit uses to calculate the position, in the third operating mode is equivalent to the electric power that the power supplying unit supplies to the part, which the position calculating unit uses to calculate the position, in the first operating mode, wherein, in the third operating mode, the power supplying unit supplies the electric power to a first part, which receives image data relating to the image, and a second part, which receives an operation to the liquid ejecting apparatus, to make the first part and the second part be in an operating state, and wherein the electric power that the power supplying unit supplies to the first part and the second part in the third operating mode is less than the electric power that the power supplying unit supplies to the first part and the second part in the first operating mode.

13. The liquid ejecting apparatus according to claim 1, wherein the electric power that the power supplying unit supplies to the part, which the position calculating unit uses to calculate the position, in the second operating mode is equivalent to the electric power that the power supplying unit supplies to the part, which the position calculating unit uses to calculate the position, in the first operating mode, wherein, in the second operating mode, the power supplying unit supplies the electric power to a first part, which receives image data relating to the image, and a second part, which receives an operation to the liquid ejecting apparatus, to make the first part and the second part be in an operating state, and wherein the electric power that the power supplying unit supplies to the first part and the second part in the second operating mode is less than the electric power that the power supplying unit supplies to the first part and the second part in the first operating mode.

14. The liquid ejecting apparatus according to claim 13, further comprising:

an operating mode changing unit configured to change the state of the liquid ejecting apparatus to the first operating mode from the second operating mode in a case where the position calculated by the position calculating unit does not change for a time longer than a predetermined time and the position is regarded as constant, wherein the return factor detecting unit detects the return factor in a case where a movement of the liquid ejecting apparatus is detected by the position calculated by the position calculating unit in the second operating mode.

15. The liquid ejecting apparatus according to claim 1, further comprising:

an operating mode changing unit configured to change the state of the liquid ejecting apparatus to the first operating mode from the second operating mode in a case where the position calculated by the position calculating unit does not change for a time longer than a predetermined time and the position is regarded as constant, wherein the return factor detecting unit detects the return factor in a case where a movement of the liquid ejecting apparatus is detected by the position calculated by the position calculating unit in the second operating mode.

16. The liquid ejecting apparatus according to claim 15, wherein, in the second operating mode, the power supplying unit supplies the electric power only to the part, which the position calculating unit uses to calculate the position, and cuts the electric power to other parts of the liquid ejecting apparatus, wherein the operating mode changing unit changes the state of the liquid ejecting apparatus to a third operating mode from the second operating mode in a case where the position calculated by the position calculating unit does not change for the time longer than the predetermined time and the position is regarded as constant, an electric power consumption of the third operating mode being less than the electric power consumption of the second operating mode, wherein the electric power that the power supplying unit supplies to the part, which the position calculating unit uses to calculate the position, in the third operating mode is equivalent to the electric power that the power supplying unit supplies to the part, which the position calculating unit uses to calculate the position, in the first operating mode, wherein, in the third operating mode, the power supplying unit supplies the electric power to a first part, which receives image data relating to the image, and a second part, which receives an operation to the liquid ejecting apparatus, to make the first part and the second part be in an operating state, and wherein the electric power that the power supplying unit supplies to the first part and the second part in the third operating mode is less than the electric power that the power supplying unit supplies to the first part and the second part in the first operating mode.

17. A liquid ejecting method that a liquid ejecting apparatus for ejecting materials on a recording medium in accordance with a position of the liquid ejecting apparatus on the recording medium and an image that is to be formed on the recording medium performs, the liquid ejecting apparatus being movable on the recording medium by an external force, the liquid ejecting method comprising;

calculating the position of the liquid ejecting apparatus on the recording medium;

supplying electric power to a part that the position calculating unit uses to calculate the position when a the state of liquid ejecting apparatus changes to a second operating mode whose electric power consumption is lower than an electric power consumption of a first operating mode of ejecting the materials on the recording medium;

detecting a return factor for returning the state of the liquid ejecting apparatus to the first operating mode from the second operating mode; and restarting to eject the materials from the position that has been calculated by the position calculating unit in the second operating mode when the state of the liquid ejecting apparatus returns to the first operating mode from the second operating mode.

18. A non-transitory recording medium storing a program that causes a liquid ejecting apparatus for ejecting materials on a recording medium in accordance with a position of the liquid ejecting apparatus on the recording medium and an image that is to be formed on the recording medium to execute processing, the liquid ejecting apparatus being movable on the recording medium by an external force, the processing comprising:

calculating the position of the liquid ejecting apparatus on the recording medium;

supplying electric power to a part that the position calculating unit uses to calculate the position when a state of the liquid ejecting apparatus changes to a second operating mode whose electric power consumption is lower than an electric power consumption of a first operating mode of ejecting the materials on the recording medium;

detecting a return factor for returning the state of the liquid ejecting apparatus to the first operating mode from the second operating mode; and restarting to eject the materials from the position that has been calculated by the position calculating unit in the second operating mode when the state of the liquid ejecting apparatus returns to the first operating mode from the second operating mode.

* * * * *